US007544289B2

(12) United States Patent
Straka et al.

(10) Patent No.: US 7,544,289 B2
(45) Date of Patent: Jun. 9, 2009

(54) DOSING ENGINE AND CARTRIDGE APPARATUS FOR LIQUID DISPENSING AND METHOD

(75) Inventors: Michael R. Straka, Middletown, CA (US); Carl H. Poppe, Sebastopol, CA (US); Carl M. Servin, Rohnert Park, CA (US); Caba Calic, Reno, NV (US)

(73) Assignee: IDEX Health & Science LLC, Northbrook, IL (US)

( * ) Notice: Subject to any disclaimer, the term of this patent is extended or adjusted under 35 U.S.C. 154(b) by 607 days.

(21) Appl. No.: 10/977,325

(22) Filed: Oct. 29, 2004

(65) Prior Publication Data

US 2005/0127097 A1 Jun. 16, 2005

Related U.S. Application Data

(60) Provisional application No. 60/515,721, filed on Oct. 29, 2003.

(51) Int. Cl.
*C02F 1/00* (2006.01)

(52) U.S. Cl. ..... 210/167.11; 222/52; 222/129; 222/132; 222/135

(58) Field of Classification Search ..... 210/167.11, 210/143; 222/129, 132, 135, 52, 148, 255, 222/325

See application file for complete search history.

(56) References Cited

U.S. PATENT DOCUMENTS

| | | | |
|---|---|---|---|
| 3,092,566 | A | 6/1963 | Negus |
| 3,286,933 | A | 11/1966 | Savage |
| 3,305,472 | A | 2/1967 | Oldershaw et al. |
| 3,351,542 | A | 11/1967 | Oldershaw et al. |
| 3,361,663 | A | 1/1968 | Murray et al. |
| 3,458,414 | A | 7/1969 | Crane et al. |
| 3,607,702 | A | 9/1971 | Haller |

(Continued)

FOREIGN PATENT DOCUMENTS

DE 19515428 A1 11/1996

(Continued)

OTHER PUBLICATIONS

PCT/US2004/036134, Transmittal of Foreign Search Report, mailed Jun. 13, 2005.

(Continued)

*Primary Examiner*—Frederick C. Nicolas
(74) *Attorney, Agent, or Firm*—Beyer Law Group LLP

(57) ABSTRACT

A liquid dispensing system is provided for automated dispensing of a plurality of liquid reagents into a recreational body of water. The liquid dispensing system includes a cartridge apparatus housing a plurality of liquid reagent containers, each containing a respective liquid reagent. A docking assembly is provided having a dock manifold device, and is releasably coupled to the cartridge apparatus between a first condition and a second condition. In a first condition, the cartridge apparatus can be removably coupled to the docking assembly, while in the second condition, the cartridge apparatus is lockably mounted to the docking assembly in a manner permitting fluid communication from the respective reagent container to respective fluid passages of the manifold device. The dispensing system further includes a dosing engine having a valve manifold device to selectively dispense the liquid reagents into the recreational body of water through a dispensing port.

59 Claims, 21 Drawing Sheets

U.S. PATENT DOCUMENTS

| | | | |
|---|---|---|---|
| 3,616,414 | A | 10/1971 | Van Houwelingen |
| 3,617,101 | A | 11/1971 | Anderson |
| 3,625,851 | A | 12/1971 | Geld |
| 3,645,862 | A | 2/1972 | Cotton et al. |
| 3,663,280 | A | 5/1972 | Lee |
| 3,746,170 | A | 7/1973 | Bloom et al. |
| 3,917,172 | A | 11/1975 | O'Hare |
| 3,926,754 | A | 12/1975 | Lee |
| 3,926,764 | A | 12/1975 | Ruzicka et al. |
| 3,957,612 | A | 5/1976 | Niedrach et al. |
| 3,959,087 | A | 5/1976 | Morrow |
| 3,986,942 | A | 10/1976 | Cook, Jr. |
| 4,012,296 | A | 3/1977 | Stephens et al. |
| 4,016,079 | A | 4/1977 | Severin |
| 4,028,197 | A | 6/1977 | Capuano |
| 4,033,830 | A | 7/1977 | Fletcher, III |
| 4,033,871 | A | 7/1977 | Wall |
| 4,039,417 | A | 8/1977 | Sasaki et al. |
| 4,052,286 | A | 10/1977 | Gray et al. |
| 4,053,382 | A | 10/1977 | Maruyama et al. |
| 4,055,477 | A | 10/1977 | Johnson |
| 4,068,528 | A | 1/1978 | Gundelfinger |
| 4,128,468 | A | 12/1978 | Bukamier |
| 4,129,479 | A | 12/1978 | Morrow |
| 4,129,493 | A | 12/1978 | Tighe et al. |
| 4,182,184 | A | 1/1980 | Bakalyar et al. |
| 4,208,376 | A | 6/1980 | Sangster et al. |
| 4,214,968 | A | 7/1980 | Battaglia et al. |
| 4,224,154 | A | 9/1980 | Steininger |
| 4,225,410 | A | 9/1980 | Pace |
| 4,233,257 | A | 11/1980 | Maruyama et al. |
| 4,235,688 | A | 11/1980 | Sudrabin et al. |
| 4,242,909 | A | 1/1981 | Gundelfinger |
| 4,282,079 | A | 8/1981 | Chang et al. |
| 4,333,812 | A | 6/1982 | Bukamier et al. |
| 4,354,915 | A | 10/1982 | Stachurski et al. |
| 4,390,406 | A | 6/1983 | Kato et al. |
| 4,440,603 | A | 4/1984 | VanEffen et al. |
| 4,495,050 | A | 1/1985 | Ross, Jr. |
| 4,496,454 | A | 1/1985 | Berger |
| 4,506,558 | A | 3/1985 | Bakalyar |
| 4,620,918 | A | 11/1986 | Bukamier et al. |
| 4,657,670 | A | 4/1987 | Newton |
| 4,767,511 | A | 8/1988 | Aragon |
| 4,792,396 | A | 12/1988 | Gundelfinger |
| 4,822,474 | A | 4/1989 | Corrado |
| 4,859,345 | A | 8/1989 | Inagaki |
| 4,917,774 | A | 4/1990 | Fisher |
| 4,959,138 | A | 9/1990 | Brinkmann et al. |
| 4,992,156 | A | 2/1991 | Silveri |
| 5,207,109 | A | 5/1993 | Olsen |
| 5,221,444 | A | 6/1993 | Silveri |
| 5,236,581 | A | 8/1993 | Perry |
| 5,254,226 | A | 10/1993 | Williams et al. |
| 5,268,092 | A | 12/1993 | Eden |
| 5,326,443 | A | 7/1994 | Hilbig |
| 5,328,574 | A | 7/1994 | Mercier |
| 5,368,706 | A | 11/1994 | Bowers et al. |
| 5,389,214 | A | 2/1995 | Erickson et al. |
| 5,398,711 | A | 3/1995 | Ardrey, Jr. |
| 5,403,451 | A | 4/1995 | Riviello et al. |
| 5,803,117 | A | 9/1998 | Olsen et al. |
| 5,895,565 | A | 4/1999 | Steininger et al. |
| 6,012,488 | A | 1/2000 | Nichols |
| 6,041,971 | A | 3/2000 | Pineda |
| 6,125,481 | A | 10/2000 | Sicilano |
| 6,155,123 | A | 12/2000 | Bakalyar |
| 6,238,555 | B1 | 5/2001 | Silveri et al. |
| 6,270,680 | B1 | 8/2001 | Silveri et al. |
| 6,340,431 | B2 | 1/2002 | Khan |
| 6,382,035 | B1 | 5/2002 | Nichols |
| 6,453,946 | B2 | 9/2002 | Nichols et al. |
| 6,672,336 | B2 | 1/2004 | Nichols |
| 6,982,040 | B2 | 1/2006 | Costa et al. |
| 7,060,190 | B2 | 6/2006 | King et al. |
| 7,258,783 | B2 * | 8/2007 | Harbol ..... 210/167.11 |
| 2002/0014410 | A1 | 2/2002 | Silveri et al. |

FOREIGN PATENT DOCUMENTS

| | | |
|---|---|---|
| EP | 0133920 | 3/1985 |
| FR | 2469708 | 5/1981 |
| WO | WO 96/30307 | 10/1996 |

OTHER PUBLICATIONS

PCT/US2004/036134, Written Opinion mailed Jun. 13, 2005.

Office of Science and Technology, Office of Water, United States Environmental Protection Agency, *Mycobacteria: Health Advisory*, EPA-822-B-01-007, Aug. 1999.

HASA, *The Halogen System*, EPA Est. #10897-CA-1.

Chemical Rubber Company, *Critical Reviews in Analytical Chemistry*, CRC Press, vol. 20, Issue 1, 1988.

Craig E. Lunte, *Voltammetricdetection for liquid chromatography*, University of Kansas, LC-CC vol. 3, No. 6.

Huiliang Huang, et al., *A Pulse Amperometric Sensor for the Measurement of Atmospheric Hydrogen Peroxide*, Anal. Chem. 1996, 68, 2062-2066.

* cited by examiner

DOSING ENGINE AND CARTRIDGE APPARATUS FOR LIQUID DISPENSING AND METHOD

RELATED APPLICATION DATA

The present application claims priority under 35 U.S.C. §119 to U.S. Provisional Application Ser. No. 60/515,721, naming Servin et al. inventors, and filed Oct. 29, 2003, and entitled DOSING ENGINE ASSEMBLY FOR A RECREATIONAL BODY OF WATER, the entirety of which is incorporated herein by reference in its entirety for all purposes.

TECHNICAL FIELD

The present invention relates to liquid dispensers, and more particularity, relates to automated liquid dispensers of reagents for recreational bodies of water.

BACKGROUND ART

Manual dispensing of a specific quantity of liquid or solid chemical into a body of water is common in industrial and residential applications. Adding laundry detergent to a clothes washer or anti-streaking wetting agent to the dishwasher are only two everyday residential examples. Consumers of appliances such as these are always searching for features that save them time and increase performance. Frequently, the feature of greatest value to the time strapped consumer is automation of the dispensing activity. Automation is highly valued by consumers since, in the examples cited above, it eliminates the need for messy manual volumetric measuring but more importantly, it removes the possibility that chemical dispensing was forgotten prior to initiating the activity.

The hot tub or pool is another example of an application where chemicals are routinely dispensed into a body of water, typically manually. In the case of a hot tub, water chemistry is critical for maintaining water sanitation and ultimately, water safety. Currently consumers are asked to regularly (at least bi-weekly) measure the condition of the water and then manually dispense an appropriate amount of a water treatment chemical or chemicals into the water. While some consumers are willing or able to accomplish this task religiously, it is well known that many residential tubs are not maintained appropriately. *Mycobacteria: Health Advisory*, United States Environmental Protection Agency, Office of Science and Technology, EPA-822-B-01-007 (August 1999). In some cases this can result in serious water quality conditions that can expose users to infectious bacteria such as mycobacteria (Id.). The main reasons these tubs are poorly maintained is consumer forgetfulness to address the water every two weeks and/or mistakes in dosing.

Given that a hot (100° F.-104° F.) body of water is significantly more susceptible to microbiological contamination, having a system that maintains superior water quality via automated water chemical dispensing into hot tubs would be a very high-value consumer product.

Further, due to the importance of proper recreational water maintenance, many pool and spa treatment systems have been developed in the past. For example, U.S. Pat. No. 4,992,156 discloses a pool purifier based on electrolytic production of chlorine. A bromine-generating system for portable spas is described in U.S. Pat. No. 6,238,555. It also uses an electrolytic cell for electrochemical bromine production, but employs an amperometric sensor for accurate determination of bromine levels in spa water. The sensor output is then used to control the power supply, and in turn, the electrolytic cell, in order to maintain bromine levels in spa water within preset limits.

Although the system is effective in producing and maintaining bromine levels in portable spas, its' operation is based on adding salts to spa water, which can lead to corrosion of metallic spa components (heaters, pumps etc.). Bromine degrades upon exposure to sunlight and is not odor-free. Also, some people's skin is too sensitive to halogens, while others find presence of salts in water objectionable.

Accordingly, there is a need for liquid dispensing systems that accomplish the task of dispensing the proper dose of water treatment chemical(s) into a pool or hot tub, thereby eliminating the errors inherent in manual additions but at least equally important, and eliminating the possibility that dosing was not accomplished at the recommended interval.

DISCLOSURE OF INVENTION

The present invention provides a liquid dispensing system for automated dispensing of a plurality of liquid reagents into a recreational body of water. The liquid dispensing system includes a cartridge apparatus defining a cavity, and a cartridge front wall. A plurality of liquid reagent containers are included, each containing a respective liquid reagent and each being disposed in the cavity in a manner permitting access to each respective liquid reagent through the front wall. A docking assembly is provided having a dock manifold device, and is releasably coupled to the cartridge apparatus between a first condition and a second condition. In a first condition, the cartridge apparatus can be removably coupled to the docking assembly, while in the second condition, the cartridge apparatus is lockably mounted to the docking assembly in a manner permitting fluid communication through the cartridge front wall from the respective reagent container to respective fluid passages of the manifold device. The dispensing system further includes a dosing engine having a valve manifold device that includes a plurality of intake ports and a dispensing port. The intake ports are fluidly coupled to the respective dock manifold fluid passages, via connection tubes, and the dispensing port is configured to deliver the liquid reagents to the body of water. The dosing engine further includes a valve assembly fluidly coupled to the valve manifold device to manipulate the flow distribution between the respective intake ports and the dispensing port. In this manner, the respective liquid reagents can then be selectively dispensed to the recreational body of water through the dispensing port.

Accordingly, a set of liquid reagents necessary to maintain recreational bodies of water (e.g., spas, pools, etc.) in a sanitary condition, can be automatically dispensed in the proper amounts and at the proper intervals. Due to the simplistic design, the cartridge apparatus, that contains liquid reagent containers, can be mounted for delivery of the reagents into the body of water, while the dosing engine can be remotely positioned in a safe location.

In one specific embodiment, the valve manifold of the dosing engine includes a stator element defining a first inlet passage fluidly coupled to one of the reagent reservoirs. The stator element includes a first inlet port of the plurality of inlet ports that terminates at a stator face lying in an interface plane. The stator element further includes a second inlet passage fluidly coupled to the dispensing port that also terminates at the stator face. The stator element also includes a third inlet passage having one portion fluidly coupled to the pump device and another portion fluidly coupled to a drive port. The valve assembly including a rotor element that defines a rotor face oriented in the interface plane in opposed relationship to and contacting the stator face in a fluid-tight manner. The rotor element defines a channel that is rotatably movable about a rotational axis, relative to the stator face, for rotational movement of the rotor face between at least a discrete first aspirate and dispense position. In first aspirate position, the channel fluidly couples the first inlet port and the drive port, while in the dispense position, the channel fluidly couples the dispensing port and the drive port.

In another embodiment, the dosing engine includes a fluid containment reservoir, having a discrete volume, in fluid communication with the drive port and the pump device for containment of liquid reagent therein. In the first aspirate position, a discrete volume of liquid reagent from the one reagent reservoir can be aspirated, via a pump device, through the first intake port, the drive port and into the containment reservoir. In the dispense position, the discrete volume of liquid reagent contained in the containment reservoir can be dispensed therefrom, via the pump device, through the drive port and out of the dispensing port.

In still another configuration, the stator element further includes a wash passage having one portion configured to fluidly couple to a wash reservoir, and another portion fluidly coupled to a wash port that terminates at the stator face. The rotor element is further rotatably movable to at least a discrete wash position. In this orientation, the channel fluidly couples the wash port and the drive port. This enables the pump device to aspirate wash fluid through the wash port, the drive port and into the containment reservoir.

The dosing engine, in one embodiment, includes a pump device that has a pump barrel defining a cavity. A reciprocating piston is disposed in the cavity, and cooperates to define a substantial portion of the fluid containment reservoir. The pump barrel is preferably angled during operation thereof in a manner creating an apex portion in the cavity. The pump barrel contains an offset pump port extending into the apex portion to facilitate purging thereof.

Another aspect of the present invention provides a liquid dispensing system for automated dispensing of a plurality of reagents into a recreational body of water. The system includes a plurality of reagent reservoirs each containing a liquid reagent, and a valve manifold device having a plurality of intake ports. Each reagent reservoir is fluidly coupled to a respective intake port. A dispensing port, in contrast, is in fluid communication with the recreational body of water. A valve assembly is movable between a plurality of discrete positions between the intake ports and the dispensing port for selective dispensing of the liquid reagents through the dispensing port and to the recreational body of water.

In still another aspect of the present invention, a liquid dispensing system is provided for dispensing of a plurality of liquid reagents, each of which is contained in a separate respective reagent container. The dispensing system includes a docking assembly having a manifold device that is configured to distribute liquids therethrough. The docking assembly further includes a mounting structure and a plurality of dock connectors in fluid communication with the manifold device. A cartridge apparatus includes a body member defines a front wall, and a central cavity therein. The cartridge apparatus further includes a first dividing wall separating the central cavity into a first compartment and an adjacent second compartment. The first and second compartments are each sized and dimensioned for receipt and support of a respective reagent container therein. The cartridge apparatus further includes a first and second connector support that is coupled to the front wall for communication with the respective first and second compartment. The first and second connector supports are each formed and dimensioned for sliding engagement with a respective collared connector therebetween to enable receipt and support of the respective reagent container in the respective first and second compartment. Further the first and second connector supports cooperate with the respective collared connecter to provide a predetermined amount of sliding longitudinal movement therebetween. The dispensing system further includes a mounting device coupled to the cartridge apparatus, and configured to cooperate with the docking assembly mounting structure for movement of the cartridge apparatus between a first condition and a second condition. In the second condition, the cartridge apparatus is removably mounted to the docking assembly. In accordance with this aspect of the present invention, during movement of the cartridge apparatus from the first condition to the second condition, the respective collared connectors of the reagent containers, slideably mounted to the respective first and second connector support, are aligned and engaged with the respective dock connector of the docking assembly for fluid-tight mating therebetween.

In one specific embodiment, the mounting device and the mounting structure cooperate for hinged movement of the cartridge apparatus relative the manifold device. Thus, during movement between the first condition and the second condition, an engagement between the respective collared connectors of the associated reagent container and the respective dock connectors is a curvilinear motion. The mounting device includes a hinge pin, while the mounting structure includes a hinge slot formed and dimensioned for sliding receipt of the hinge pin. In a locking position, the mounting device is releasably locked to the mounting structure, and enables the hinged movement of the cartridge apparatus about a rotational axis of the hinge pin between the first condition and the second condition.

In still another aspect of the present invention, a transportable reagent cartridge apparatus is provided including a body member defining a central cavity therein, and having a front wall. A first dividing wall is included that separates the central cavity into a first compartment and an adjacent second compartment. Each compartment is sized and dimensioned for receipt and support of a respective reagent container therein. A first and second connector support is also included that is coupled to the front wall for communication with the respective first and second compartment. Further, each connector support is formed and dimensioned for sliding engagement with a respective collared connector therebetween to enable receipt and support of the respective reagent container in the respective first and second compartment. The connector supports further cooperate with the respective collared connecter to provide a predetermined amount of sliding longitudinal movement therebetween. The cartridge device further includes a mounting device coupled to the body member, and is configured to cooperate with the docking assembly mounting structure between a first condition and a second condition. During movement of the cartridge apparatus from the first condition to the second condition, the second condition of which the cartridge apparatus is removably mounting to the docking assembly, the respective collared connectors, slideably mounted to the respective connector supports, are aligned and engaged with the respective dock connector for fluid-tight mating therebetween.

In one specific embodiment, each connector support includes a U-shaped groove extending downwardly from a lower edge portion of the front wall, and formed for sliding receipt of the respective collared connector therein. Each connector support includes a first tang and an opposed second tang extending into a respective groove thereof. The first and second tangs cooperate with the respective collar connectors to retain the collar connector in the respective groove.

In another configuration, the first dividing wall further cooperates with the body member to define pocket compartment proximate to the front wall. This pocket compartment is formed and dimensioned for receipt of a respective reagent container therein. The pocket portion of the first dividing wall is Y-shaped proximate to and cooperating with the front wall to form a portion of the pocket compartment.

In still another specific embodiment, the cartridge apparatus includes a strap device mounted to the body member, and extending over the cavity opening in a manner retaining respective reagent containers in the respective first and second compartments during transportation. To facilitate alignment and retention of the strap device, the body member includes at least one strap alignment groove along an exterior wall thereof that is formed and dimensioned for aligned receipt of the strap device.

BRIEF DESCRIPTION OF THE DRAWING

The assembly of the present invention has other objects and features of advantage which will be more readily apparent from the following description of the best mode of carrying out the invention and the appended claims, when taken in conjunction with the accompanying drawing, in which:

BEST MODE OF CARRYING OUT THE INVENTION

Figure 1:
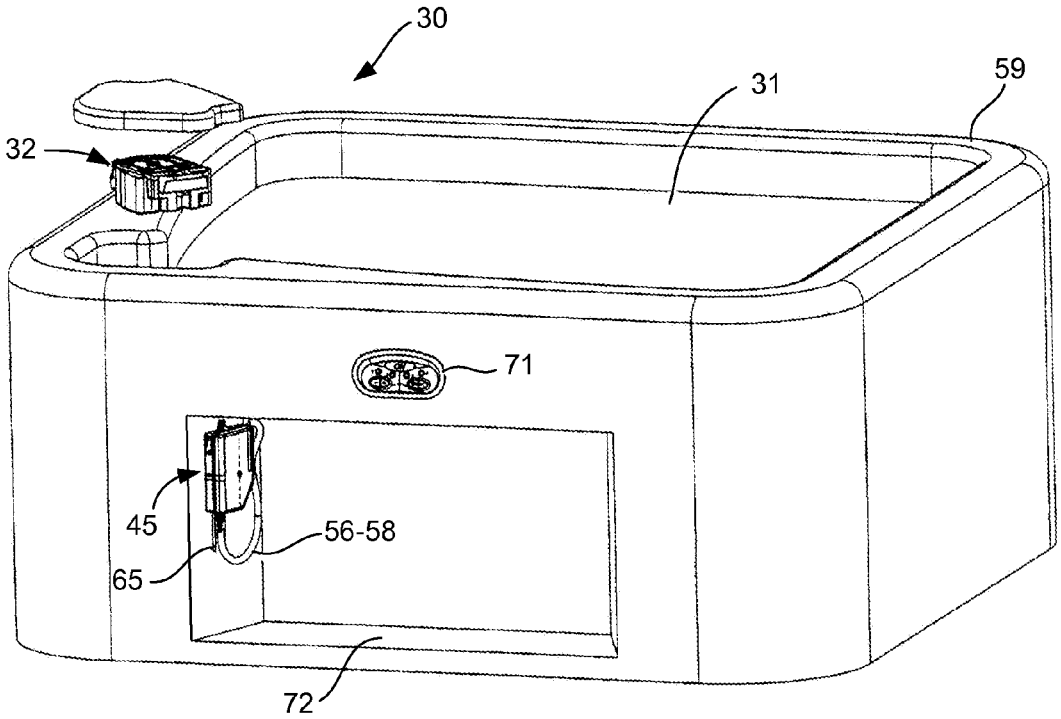
FIG. 1 is an exploded top perspective view of a spa assembly incorporating a liquid dispensing system designed in accordance with the present invention.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Referring now generally to FIGS. 1-8, a liquid dispensing system, generally designated 30, is provided for automated dispensing of a plurality of liquid reagents into a recreational body of water 31. The dispensing system 30 includes a cartridge apparatus (FIGS. 5-6), generally designated 32, defining a cavity 33, and a cartridge front wall 34. The system further includes a plurality of liquid reagent containers (e.g., 35-37) containing a respective liquid reagent. Each reagent container 35-37 is disposed in the cavity 32 in a manner permitting access to each respective liquid reagent through the front wall 34. A docking assembly, generally designated 38, includes a dock manifold device 40, and is configured to releasably couple to the cartridge apparatus 32 between a first condition (FIG. 11A) and a second condition (FIG. 11C). In the second condition, the cartridge apparatus 32 is movably mounted to the docking assembly 38 in a manner permitting fluid communication, through the cartridge front wall 34, from the respective reagent container 35-37 to respective fluid passages (e.g., passage 41 of which is only shown) of the manifold device 40. The dispensing system 30 further includes a dosing engine (FIGS. 3-4B), generally designated 45, having a valve manifold device 46. The valve manifold device includes a plurality of intake ports (e.g., 50-52) fluidly coupled to the respective dock manifold fluid passages 41, and a dispensing port 53 to deliver the liquid reagents to the body of water. The dosing engine 45 further includes a valve assembly 55 fluidly coupled to the valve manifold device 46 to manipulate the flow distribution between the respective intake ports 50-52 and the dispensing port 53 for selective dispensing of the respective liquid reagents through the dispensing port and to the recreational body of water.

Figure 2:
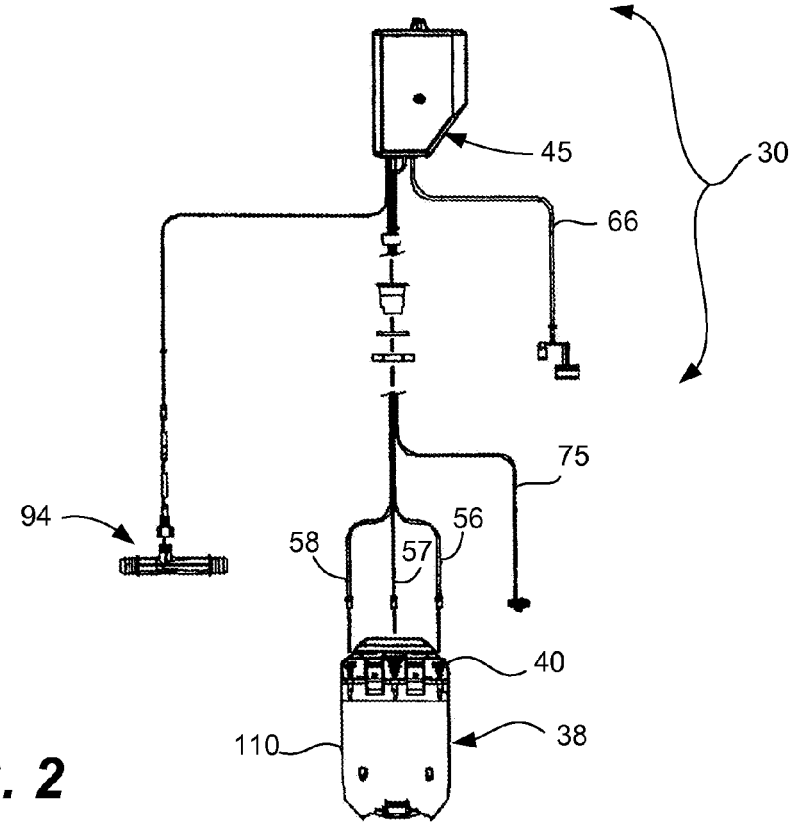
FIG. 2 is a schematic diagram of the liquid dispensing system of FIG. 1.

As best viewed in FIGS. 1 and 2, an automated liquid reagent delivery system 30 is disclosed providing a plurality of liquid reagent containers 35-37 disposed in a carrying cartridge apparatus 32 that can be removably mounted to the docking assembly 38. The docking assembly 38 is fluidly coupled to the dosing engine 45, via connection tubes 56-58, configured to automate the selection, amount and frequency of the liquid reagent dispensing into a recreational body of water such as a pool or a spa 59. Pools and spas, for example, have a set regiment liquid reagents necessary to maintain the water in a sanitary condition. For example, waterline, liquid oxidizer sanitizer and/or pH adjustment chemicals are typically required.

Moreover, the multi-liquid dispensing system of the present invention is particularly suitable for dispensing multiple liquid reagents of different viscosities. Typically, dispensing liquids of different viscosity is problematic in that it creates a high level of force against the pump resulting in excess deflection with a corresponding decrease in pump efficiency. The dispensing system of the present invention, however, is capable of handling different viscosity liquids since it has been specifically designed with the maximum viscosities anticipated.

Figure 3:
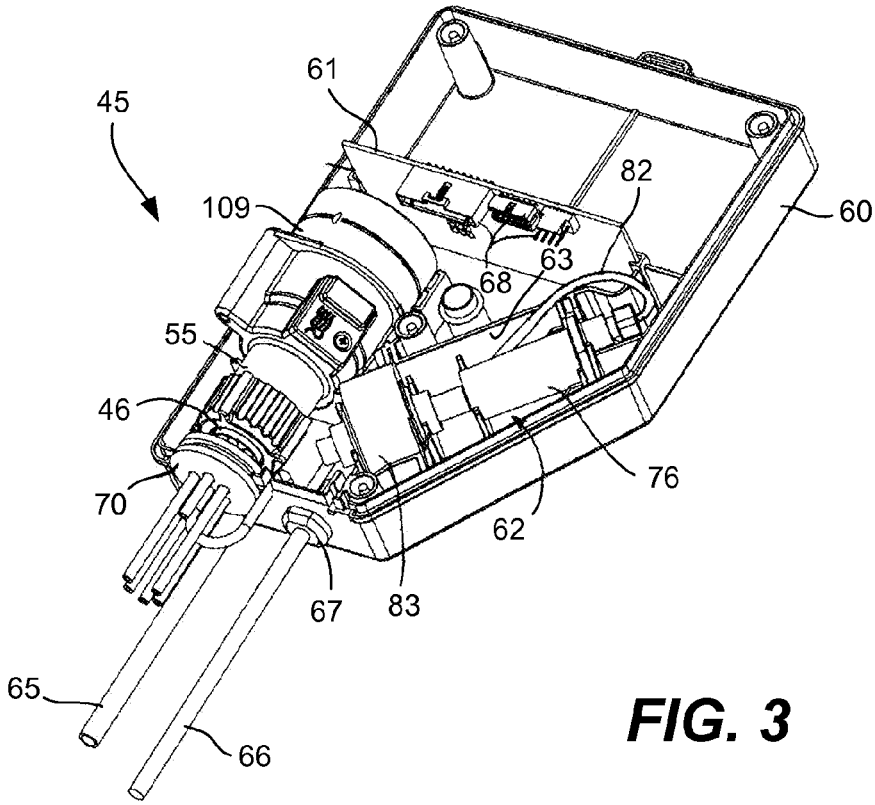
FIG. 3 is an enlarged top perspective view of a dosing engine of the liquid dispensing system of FIGS. 1 and 2, with a top cover of a housing thereof removed.
Figure 4A:
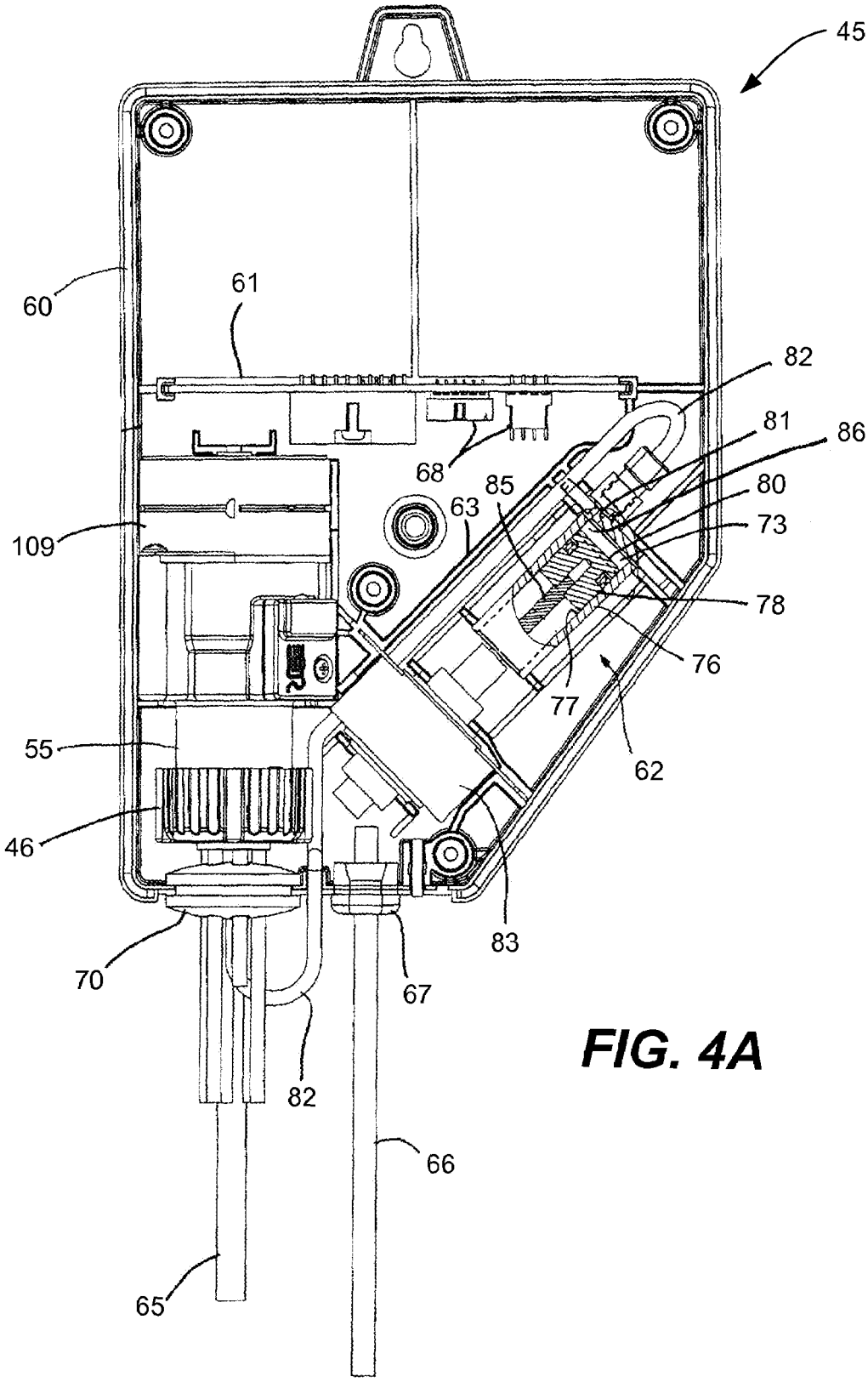
FIGS. 4A and 4B is a series of enlarged side elevation views, partially broken away, of the dosing engine of FIG. 3, illustrating movement of a pump device between an extended and retracted position.
Figure 4B:
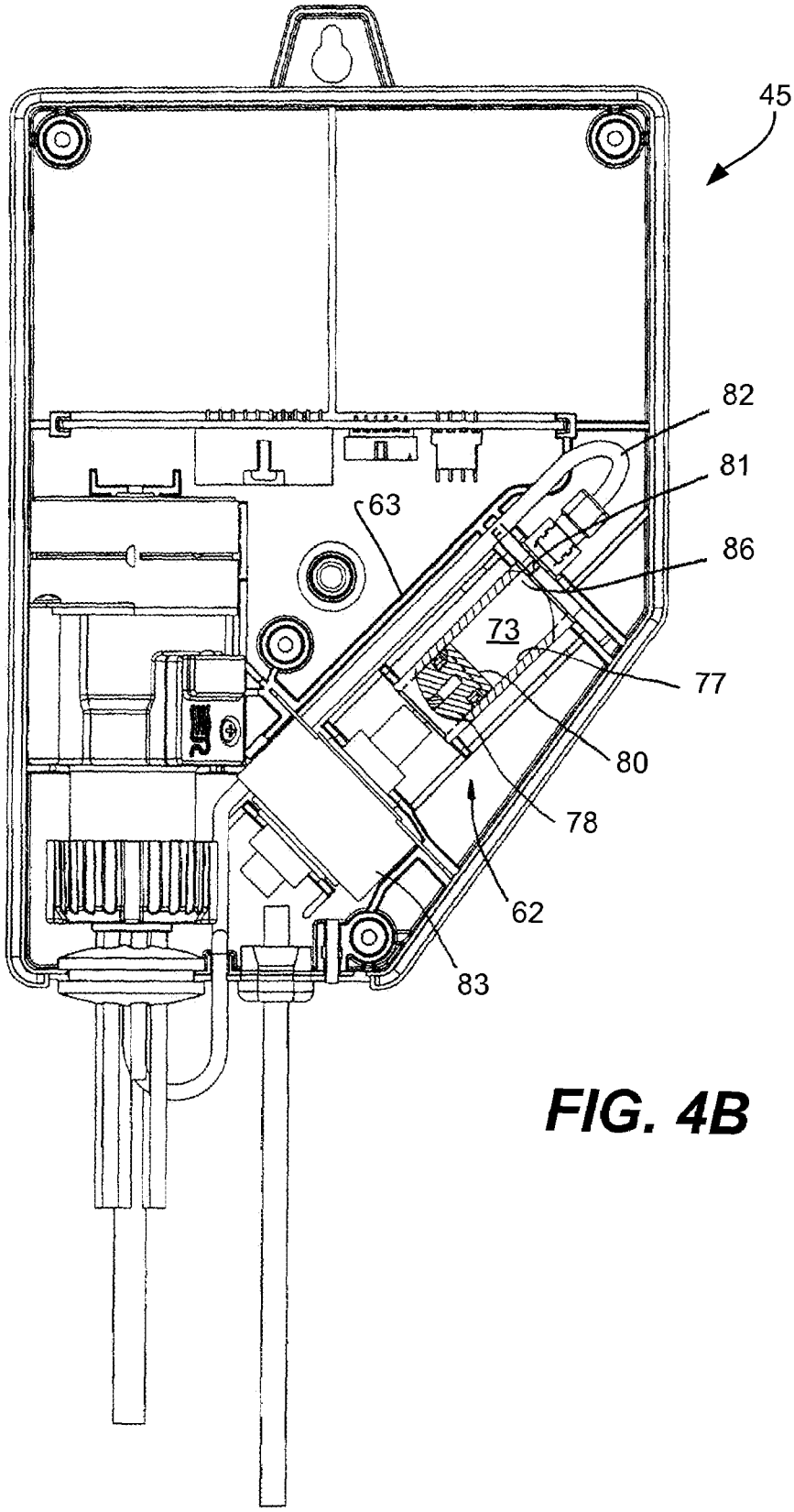

Referring now to FIGS. 3-4B, the dosing engine 45 will be described in greater detail. Briefly, the dosing engine 45 is essentially the motor of the system that enables the fluid distribution, the control systems, and the aspiration and dispensing source. The dosing engine 45 includes a compartmentalized housing 60 preferably enclosing the components to shelter the same from moisture and casual access. The hollow housing is preferably provided by a molded polymer material such as plastic, but can be composed of other materials as well More specifically, the components include a control circuit board 61, a pump device 62, a valve assembly 55 and a liquid valve manifold device 46. The control circuit board 61 is positioned near the top of the housing 60, when in operation, in an effort to reduce moisture contact. Further, an isolation wall 63 is positioned between the control circuit board 61 and the mechanical fluid handling components (i.e., the valve assembly 55 and the pump device 62) to provide the primary isolation from potential moisture contact, shorting and corrosion.

At the lowermost position, a drainage device 65 is provided that enables drainage from the compartment should the fluid handling components leak. A power and control cord 66 also enters into the compartment through a grommet 67 at the bottom of the housing 60, which connects, to sockets 68, the connections of which are not illustrated. Another grommet 70 on the other bottom side of the housing 60 is provided that enables access of the connection tubes 56-58 from the dock manifold device 40 to the valve manifold device 46.

As best viewed in FIG. 1, a user interface 71 mounted to the spa 59, for instance, is coupled to the dosing engine 45 through the power and control cord 66 for control and operation thereof. Briefly, while the dosing engine 45 can be mounted virtually anywhere, it is preferred to positioned the engine in a safe location to reduce unauthorized access and environmental exposure. Hence, one preferred location would be to simply mount the unit within the confines of cabinetry 72 or the like.

As mentioned above and as shown in FIG. 3-4B, the mechanical fluid handling components of the dosing engine 45 includes the valve manifold device 46and the valve assembly 55. These components collaborate to manipulate the fluid distribution together with the pump device 62. Briefly, as will be described in greater detail, in an aspiration mode (FIG. 8A), the liquid reagents can be aspirated from a selected reagent reservoir (i.e., the reagent container 35-37) into a containment reservoir 73 for storage thereof. Moreover, in a dispensing mode (FIG. 8B), the stored reagent in the containment reservoir 73 is dispensed through a dispensing port 53 of the valve manifold device 46. To deliver the reagent, a dispensing tube 75 fluidly communicates with the body of water 31.

Each reagent container 35-37 is fluidly coupled the dosing engine 45 through the discrete connection tubes 56-58, one for each reagent container 35-37. More particularly, each connection tube 56-58 preferably extends from the dock manifold device 40 of the cartridge apparatus 32 to the valve manifold device 46 of the dosing engine. While these connection tubes are illustrated as continuous, intermediate interconnections are preferably included (not shown) to facilitate installation. These connection tubes are preferably flexible to facilitate installation, and are material selected to be compatible with the liquid reagents dispensed so as not to adversely react with any of them. Typical of such tube materials include TEFLON and polyethylene, PEEK and polypropylene.

In accordance with the present invention, the delivery of liquid reagents should be relatively precise, both in volume and frequency. This assures a proper sanitation level. To facilitate such relatively precise volumetric delivery, a rotary-style switching valve and syringe-style pump are employed to accurately manipulate and dispense the liquid reagent.

The pump device 62, as illustrated in FIGS. 4A and 4B, includes a pump barrel 76 defining an interior cavity 77 and a pump piston 78 therein. Both the interior cavity 77 and the peripheral surface of the pump piston 78 are preferably cylindrical-shaped, and reciprocate between a fully extended position (in FIG. 4A, the pump piston 78 is shown nearly fully extended) and a fully retracted position (FIG. 4B). The circular end surface 80 of the pump piston 78 and the interior cavity 77 cooperate to define a variable volumetric fluid containment reservoir 73. This storage space contains the aspirated liquid reagent therein, in a precise volume that will be dispensed through the dispensing port 53 and into the body of water, as will be discussed.

To aspirate the liquid reagent (or any liquid) into the containment reservoir 73 of the pump barrel 76, the pump piston 78 is retracted from the extended position (FIG. 4A) toward a retracted position (FIG. 4B). A vacuum is generated that draws the liquid reagents through a pump port 81 in the pump barrel 76 via pump tube 82.

By accurately controlling the displacement of the pump piston 78, the volume of the liquid aspirated or dispensed from the containment reservoir 73 can be accurately controlled. To Such precise linear control is performed by a linear stepper motor 83 that is coupled to a rod 85 of the pump piston 78. This stepper motor 83 is preferably designed to "home" into position without a position sensor (no feedback) using a mechanical stop on a motor shaft thereof.

One example of these type pumps is that provided by Rheodyne Model No. MLPP777-111, which offer precise liquid delivery in the range of about 0.010 cc to about 1.0 cc. It will be appreciated, of course, that since a syringe-style pump is be applied, the diameter of the piston and the length of the stroke may be selected to dictate volume of liquids contained and delivered.

In accordance with one aspect of the present invention, the pump barrel 76 is angled upwardly in the housing to facilitate purging of any trapped bubbles contained within the containment reservoir during operation. As best viewed in FIG. 4A, by angling the pump barrel 76 (preferably about 45°), an apex portion 86 in the cavity 77 is created where any bubbles will flow to facilitate purging, and thus maintain the dispensing efficiency of the pump device. Access to the apex portion 86 is provided through the pump port 81, which is offset from a central longitudinal axis of the pump barrel 76. Accordingly, any trapped bubbles are easily discharged from the barrel interior cavity 77 through the offset pump port.

Figure 7:
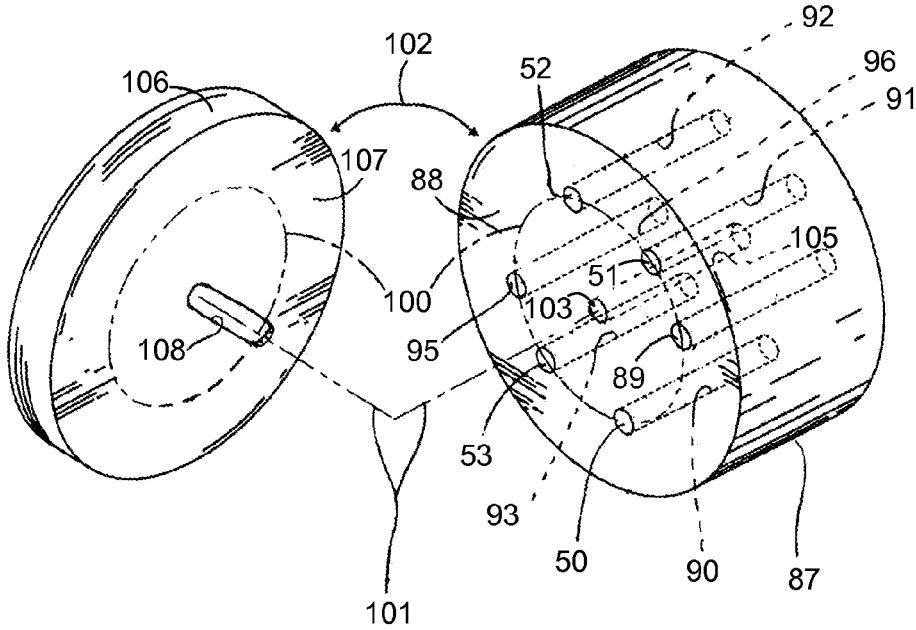
FIG. 7 is an exploded, enlarged, top perspective view of a stator element and a rotor element of a valve assembly of the dosing engine of FIG. 3.

As above indicated, the valve manifold device 46 and the valve assembly 55 are preferably provided by a rotary-style valve. In this specific embodiment, the manifold device 46 includes a stator element 87 having a substantially planar stator face 88 (FIG. 7). Extending through the stator element 87 is a plurality of intake passages 90-92 that terminate at respective intake ports 50-52 at the stator face 88. Each reagent intake port 50-52 and associated intake passage 90-92 are coupled to a corresponding that reagent container 35-37, via the connection tube 56-58 and dock manifold device. This will be described in greater detail below in reference to FIG. 8A.

The stator element 87 further includes a dispensing port 53 at the stator face 88 along with a corresponding dispensing passage 93 that extends through the stator element. As mentioned, the dispensing passage 93 is preferably connected to dispensing tube 75, which delivers the liquid reagent into the body of water 31. It will be appreciated that more or less intake ports can be provided along the stator face. For instance, more than three liquid reagent intake ports 50-52 may be provided should it be necessary to dispense a fourth (or more) liquid reagent. By way of another example, a port 89 may be provided to dispense other materials such as ozone distribution 94, as shown in FIGS. 2 and 7.

In accordance with still another aspect of the present invention, the stator element 87 also defines a wash port 95 positioned at the stator face 88 and a corresponding wash passage 96 that extends through the stator element. The wash passage 96 is fluidly coupled to a wash reservoir 97 of wash fluid, the use of which will be discussed below in reference to FIG. 8C. To fluidly couple the wash passage 96 to the wash reservoir 97, flexible tube 98 is employed.

FIG. 7 best illustrates that each of the reagent intake port 50-52, the dispensing port 53 and the wash port 95 are contained within in imaginary circle 100 placed about a rotational axis 101 of a rotor-stator interface plane 102. Moreover, these ports are equally spaced apart from one another. At the center of the rotation axis 101 is a fluid drive port 103 having a central passage 105 extending through the stator element 87. The central passage 105 and the drive port 103 are fluidly coupled to the pump barrel 76 via the pump tube 82. As will be described below, this fluid connection permits fluid aspiration to and dispensing from the containment reservoir of the pump barrel.

The valve assembly 55 further includes a rotor element 106 that defines a substantially planar rotor face 107 oriented in an interface Plane 102 that also contains the stator face 88 of the stator element. These two surfaces are in opposed relation to one another, and form a fluid-tight seal when in operation. Inset within the rotor face 107 of the rotor element 106 is a channel 108 that extends radially from the rotational axis 101 to the imaginary circle 100. This channel 108 provides a communication bridge from the drive port 103 to one of the intake ports 50-52, the dispensing port 53 or the wash port 95, depending upon its discrete rotational orientation.

The rotor face 107 of the rotor element is preferably composed of thermoplastic material such as UHMWPE In contrast, the stator face 88 of the stator element is preferably composed of a more rigid material such as Kel-F (PCTFE) Applying a sufficient compression force between the rotor element 106 and the stator element 87, a fluid-tight seal is formed at the interface plane 102. Hence, using a stepped motor 109 (FIG. 3), the rotor element 106 is rotated discretely about the rotational axis 101. The rotor channel 108 fluidly bridges the pump device 62 to one of the reagent containers 35-37, the body of water 31 or the wash reservoir 97.

Typical of such rotary-style switching valve assemblies is the TITANEX® valve, Model No. MLP777-206 by Rheodyne, LLC of Rohnert Park, Calif. It will be appreciated that other rotor-style valves may be employed. Moreover, to perform the same fluid distribution functionality, other dock manifold/valve configurations can be employed such as two-way or three-way switching valves.

Figure 8A:
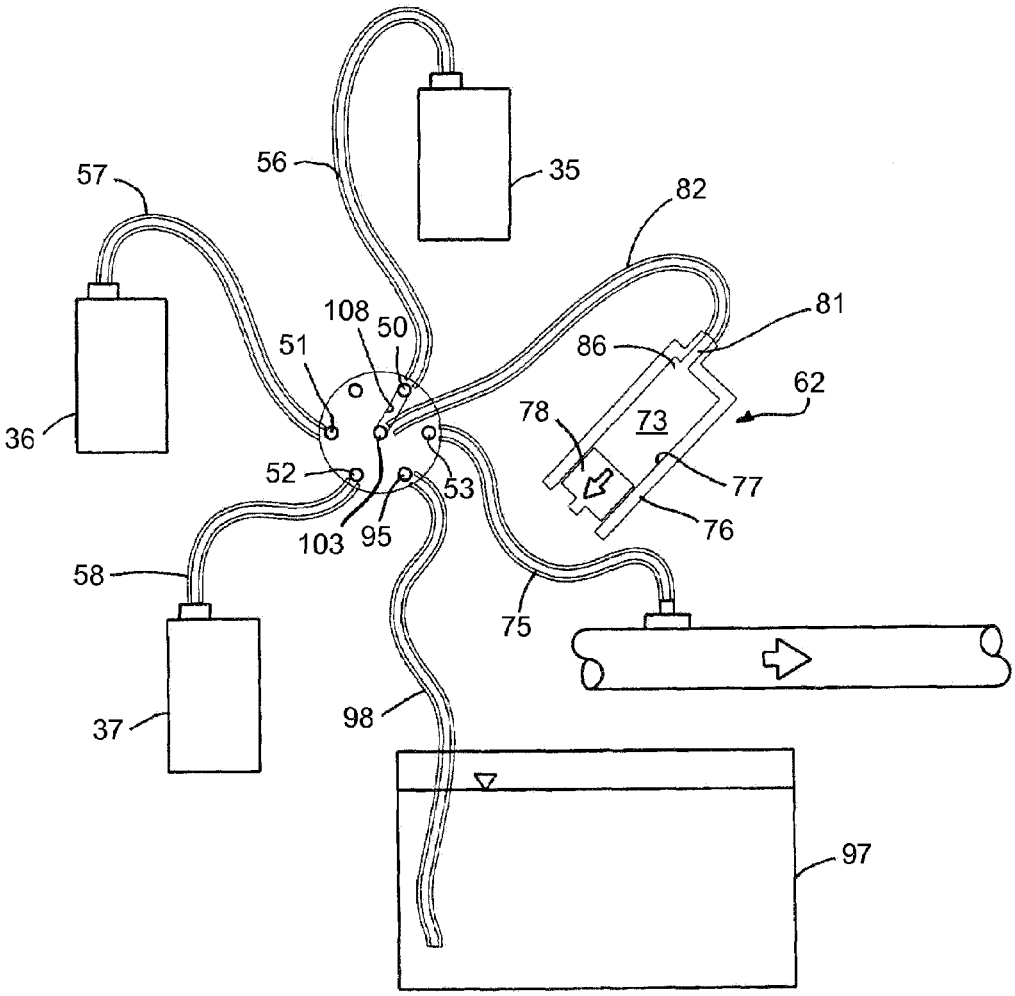
FIGS. 8A-8C is a series of schematic diagrams illustrating partial operation of the liquid dispensing system of FIGS. 1 and 2.
Figure 8B:
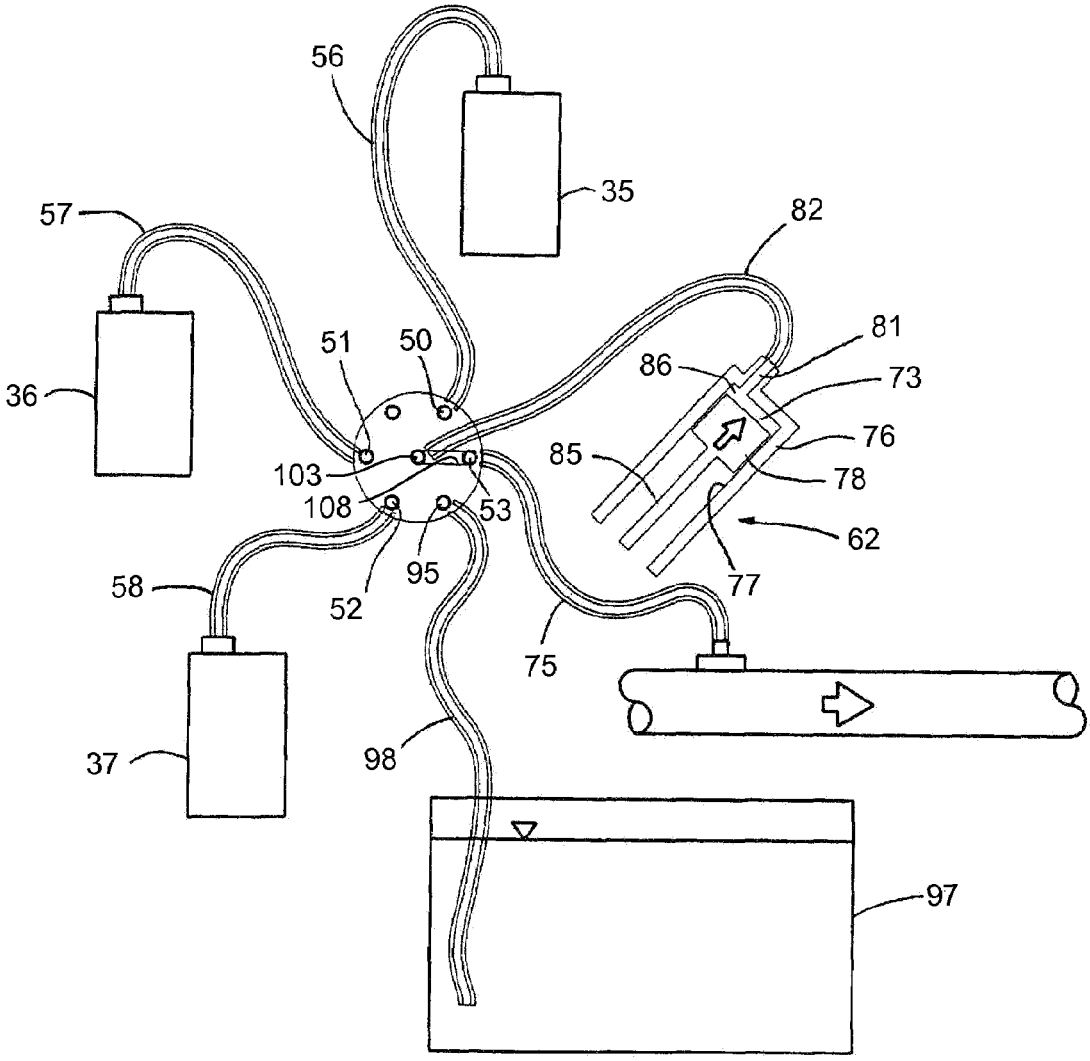
Figure 8C:
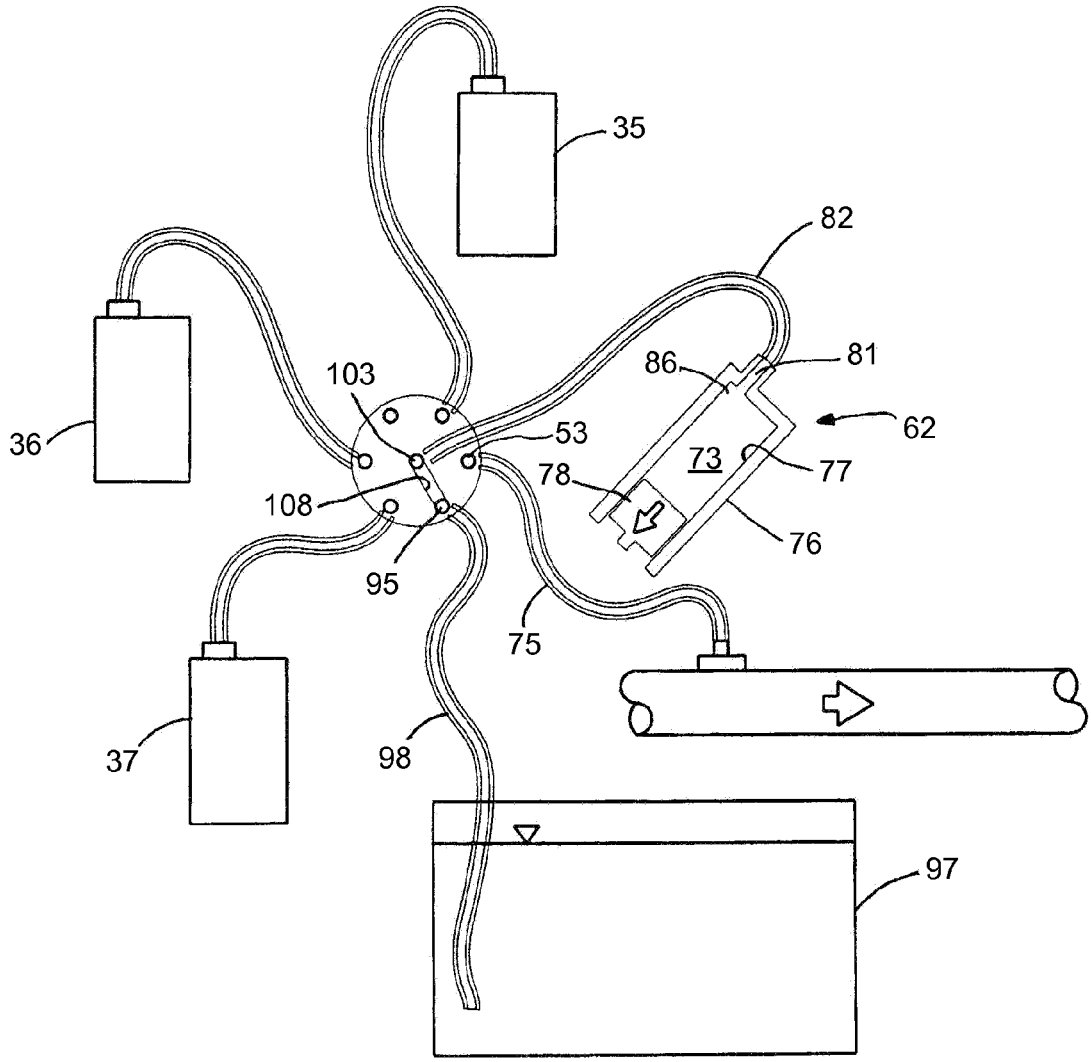

Referring now to FIGS. 8A-8C, partial operation of the liquid dispensing system will be described in greater detail. To aspirate one of the liquid reagents (in this example, reagent container 35) into the containment reservoir 73 of the pump barrel 76, the rotor channel 108 is radially oriented to fluidly bridge the pump device 62 to the corresponding intake port 50.

As the pump piston 78 is retracted from the extended position (FIG. 4A) to the retracted position (FIGS. 4B and 8A), the volumetric capacity of the containment reservoir 73 is increased, creating suction to draw the liquid reagent. Depending upon the desired volume of liquid reagent to be dispensed, the pump piston 78 can be accurately actuated.

Turning now to FIG. 8B, the rotor element 106 is discretely rotated about the rotational axis 101 to fluidly bridge the pump device 62 to the dispensing port 53. The pump piston 78, thus, can be actuated for movement from the retracted position (FIG. 8A) toward the extended position (e.g., FIG. 8B). In this orientation, the contained liquid reagent can be dispensed from the containment reservoir, through the drive port 103 and dispensing port 53 (via channel 108), and on to the recreational body of water 31 (via dispensing tube 75).

Although dedicated intake ports 50-52 are utilized for each liquid reagent during aspiration, once past the intake ports, the path to the pump device and out through the dispensing port is common. Cross-contamination of the pump components, accordingly, can be problematic. To address this issue, the stator element 87 includes a wash port 95 fluidly coupled to a wash reservoir that can be bridged, via the rotor channel 108, to the containment reservoir 73.

At a discrete wash position, as shown in FIG. 8C, the rotor element 106 is positioned to bridge the wash reservoir 97 to the pump device 62. More particularly, the ends of the rotor channel 108 are rotated into fluid communication between drive port 103 and the wash port 95. As described above, the pump piston 78 is operated to draw the wash fluid into the containment reservoir 73 for washing thereof. As also described above in reference to FIG. 8B, the wash fluid can be discarded from the containment reservoir 73 through the dispensing port 53. Repeating this wash sequence, the containment reservoir 73 can be adequately cleaned.

Figure 5:
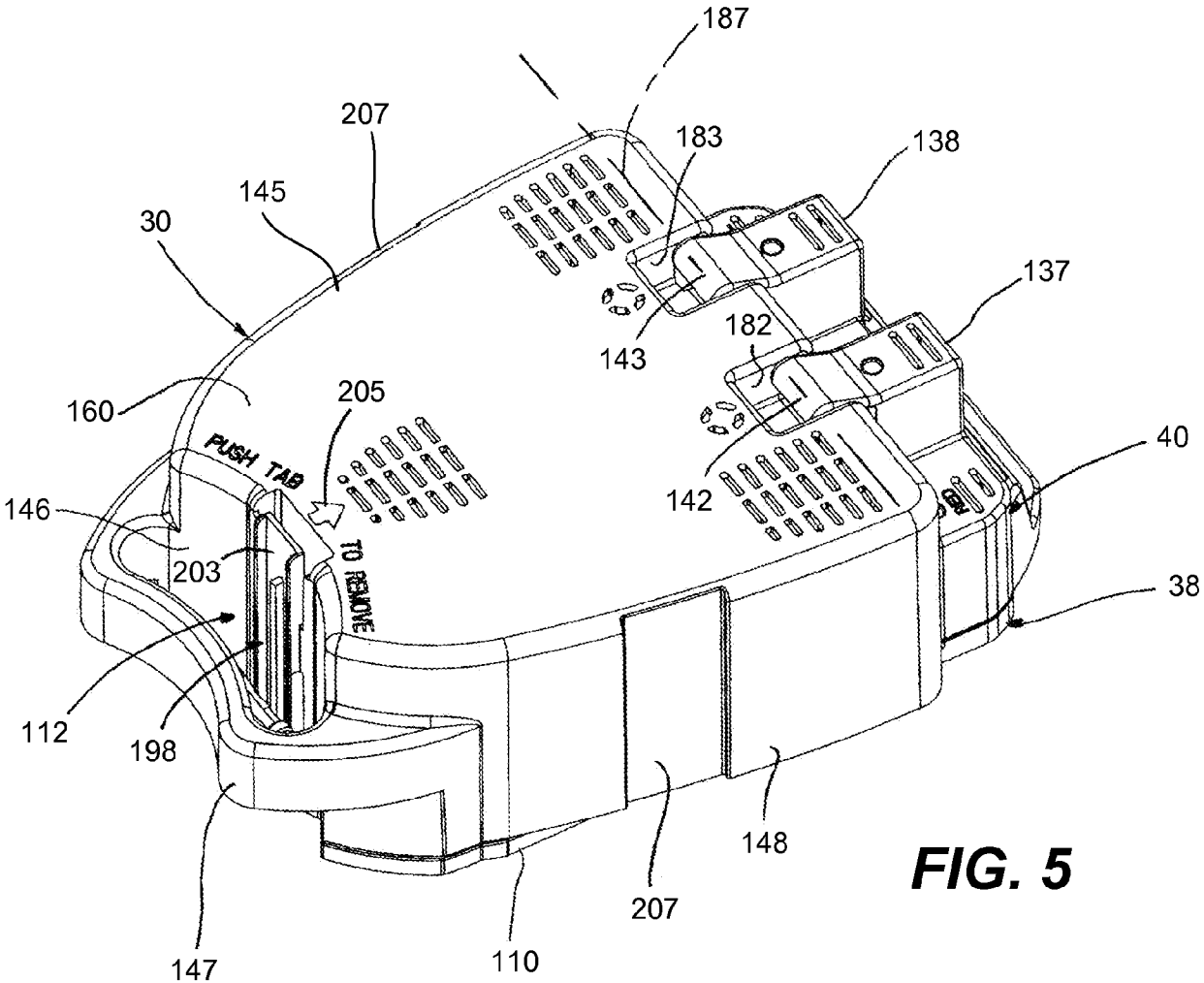
FIG. 5 is an enlarged top perspective view of a reagent cartridge apparatus and docking assembly of the liquid dispensing system of FIGS. 1 and 2, in a closed second condition.
Figure 6:
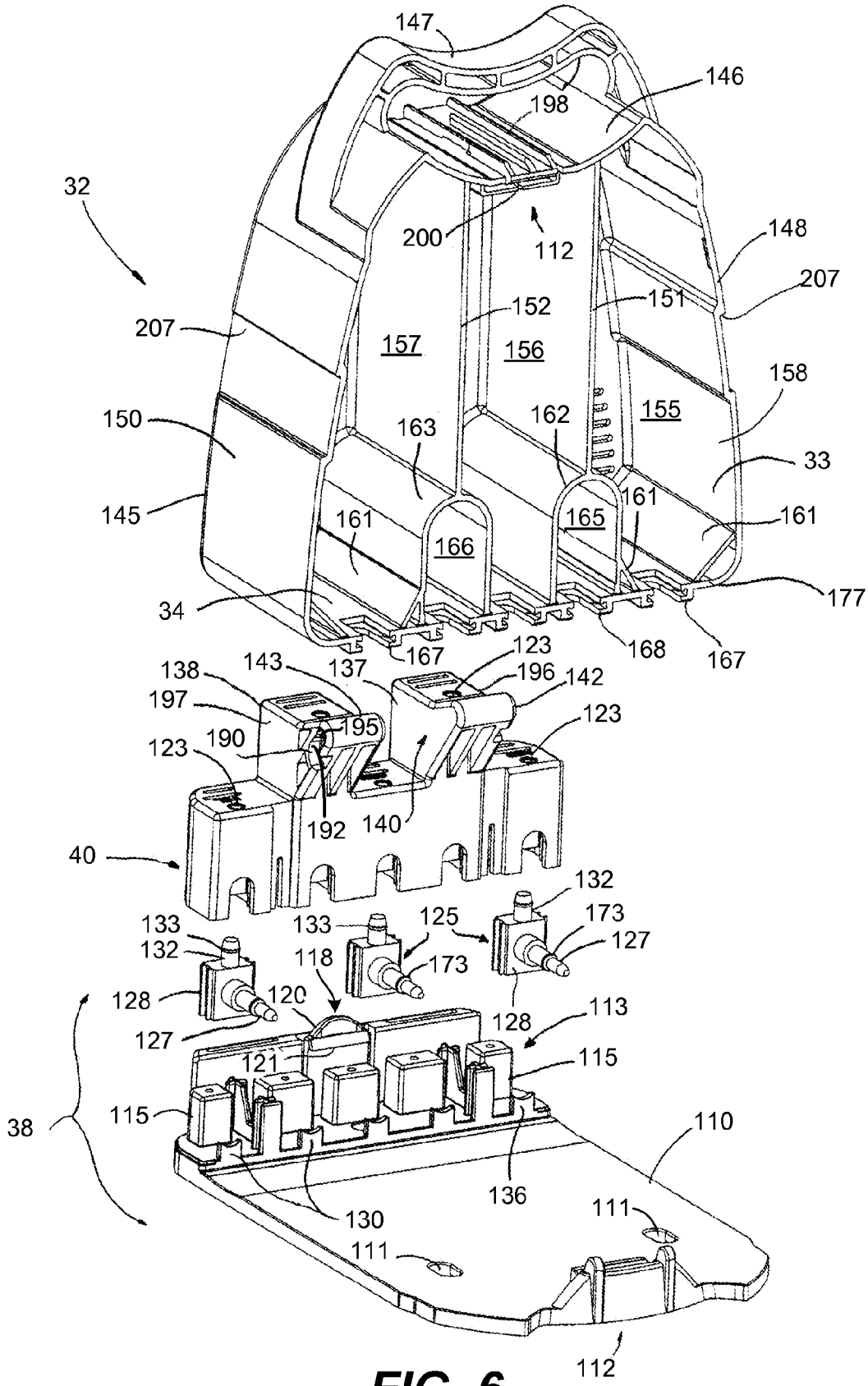
FIG. 6 is an exploded, enlarged, top perspective view of the assembly of FIG. 5, in an opened first condition.

Turning to FIGS. 5, 6, and 9-11C, the cartridge apparatus 32 and docking assembly 38 are now described in greater detail. As best shown in FIG. 6, the docking assembly 38 includes a base member 110 upon which the cartridge apparatus 32 mounts and releasably locks. The base member 110 is preferably plate-like, and is configured to mount the entire assembly proximate to the spa or body of water for use and operation thereof. Such mounting may be performed through conventional screws (not shown) and screw receptacles 111, or through an adhesive backing.

Briefly, at one end of the base member 110, a cartridge latch assembly 112 cooperates with the cartridge apparatus to releasably lock the same to the docking assembly 38. This cartridge latch assembly 112 will be described in greater detail below. On an opposite end of the base member 110 is an upstanding support structure 113 upon which the dock manifold device 40 is removably mounted. The layout of the support structure 113 is a custom keyed geometry that enables slideable mounting of the dock manifold device 40 thereto for proper location and orientation without the use of fasteners. This is primarily provided by an array of upstanding alignment posts 115 that are formed and dimensioned for sliding receipt in a corresponding array of post receiving slots 116 at a bottom of the dock manifold device 40 (FIG. 11). As shown, each alignment post 115 is slightly tapered inwardly such that as the dock manifold device 40 is press-fit downwardly onto the support structure 113, the alignment posts are increasingly friction fit against the interior walls 117 that define the respective post receiving slots 116.

A manifold latch assembly 118 is provided between the dock manifold device 40 and the support structure 113. FIGS. 11B and 11C best illustrate that the latch assembly 118 includes a resilient latch lever 120 upstanding from the support structure 113. As the dock manifold device 40 is pushed down upon the alignment posts 115, a retention tang 121 of the resilient latch lever 120 contacts a ramped shoulder 122 of the dock manifold device 40. Upon further movement, the retention tang 121 extends past a ledge portion of the ramped shoulder 122 to secure the manifold device in place. Hence, through manual operation of the resilient latch lever 120, the dock manifold device 40 can be selectively unlocked from the base member 110 which is beneficial to replace parts and/or to add or subtract connector components and tubes as required or needed.

In accordance with the present invention, the function of the dock manifold device 40 is to fluidly couple the reagent containers 35-37 to the valve manifold device 46 of the dosing engine 45, via connection tubes 56-58. To provide such fluid communication, the dock manifold device 40 includes a plurality of dock manifold fluid passages 41 extending through the manifold. While only passage 41 is shown, each passage is generally identical corresponds to a respective connection tube 56-58 and a respective reagent container 35-37. An upper end of each fluid passage includes a corresponding manifold connector port 123 configured to receive a fluid connector (not shown) of a respective connection tube 56-58. Preferably, the connector ports 123 are threaded for receipt of a threaded ¼-28 style fluid connector. It will be appreciated, however, that virtually any type of fluid connector can be employed for fluid coupling of the connection tubes 56-58 to the manifold. Moreover, it will be understood that while five connector ports 123 are illustrated (only three of which are shown in use), the manifold can be configured to accommodate any number of fluid passages.

At an opposite end, the manifold fluid passages are configured to fluidly couple respective to the dock connectors 125 mounted to the dock manifold device 40. Briefly, as will be described in greater detail below, these dock connectors 125 releasably mate with corresponding collared connectors 126 mounted to the cartridge apparatus 32, when the cartridge apparatus is mounted to the docking assembly 38. In the preferred arrangement, these dock connectors are male-type connectors having associated pin portions 127 that extend outward from the dock manifold device 40 in a direction substantially parallel to the plate-like base member 110 (FIGS. 6 and 11).

In this manner, dock connectors 125 are preferably 90° angled connectors that include a corresponding connector base portion 128 adapted to be press-fit into connector receiving slots 130 (only one of which is shown in FIGS. 11B and 11C). Upstanding from each connector base portion 128 is a corresponding nozzle portion 132 with an O-ring seal 133. When the dock connectors 125 are press-fit mounted to the dock manifold device 40, the corresponding O-rings 133 engage respective interior receiving walls 135 (again, only one of which is shown in FIGS. 11B and 11C) of the receiving slots 130. This forms a fluid-tight seal with the corresponding nozzle portions 132 and with the respective fluid passage 41.

To further promote vertical load bearing support to the pin portions 127 of the dock connectors 125 when the cartridge apparatus 32 is mounted to the docking assembly 38, the support structure includes a plurality of neck supports 136 each upstanding from the base member 110, and corresponding to a dock connector 125. As shown in FIGS. 6 and 11, when the dock manifold device 40 is press-fit mounted to the support structure 113, the necks of the pin portions 127 are seated against the neck supports 136 to promote the aforementioned vertical support. The necessity for such a vertical load bearing support will be apparent when describing the engagement of the dock connectors 125 with the corresponding collared connectors 126 of the cartridge apparatus 32.

The dock manifold device 40 further includes two spaced-apart towers 137, 138 upon which the cartridge apparatus is movably mounted. More specifically, these upstanding towers 137, 138 include the respective mounting structure 140 which are contained and supported by respective cantilevered mounting posts 142, 143 extending outwardly over the base member 110. As will be described in more detail below, these cantilevered mounting posts 142, 143 function to movably mount the cartridge apparatus 32 to the docking assembly 38 along a curvilinear path that effectively engages the dock connectors 125 to the corresponding collared connectors 126.

Referring back to FIGS. 5 and 6, the cartridge apparatus 32 will now be described. The cartridge apparatus preferably includes a body member 145 that defines a central cavity 33 therein. At one end of the body member 145 is a generally planar front wall 34, while at an opposite end is a rear wall 146 that supports a handle member 147. A pair of opposed sidewalls 148, 150 extend between the rear wall 146 and front wall 34 for support thereof. The body member further includes a first and second dividing wall 151, 152 separating the central cavity 33 into a first compartment 155, an adjacent second compartment 156 and an adjacent third compartment 157. Each compartment 155-157 is sized and dimensioned for receipt and support of a respective reagent container 35-37 therein.

In one configuration, the body member 145 of the cartridge apparatus 32 is generally a rectangular shell-shaped structure having a bottom opening 158 into the cavity 33. The body member 145, as well as the docking assembly components are both preferably composed of a light-weight, relatively high-strength material having good load bearing, yet resilient properties. Due to the complex form and shapes of the assemblies, however, a moldable material is more cost effective and is very much preferred. Typical of such materials include thermoplastic, ABS, etc.

Figure 9:
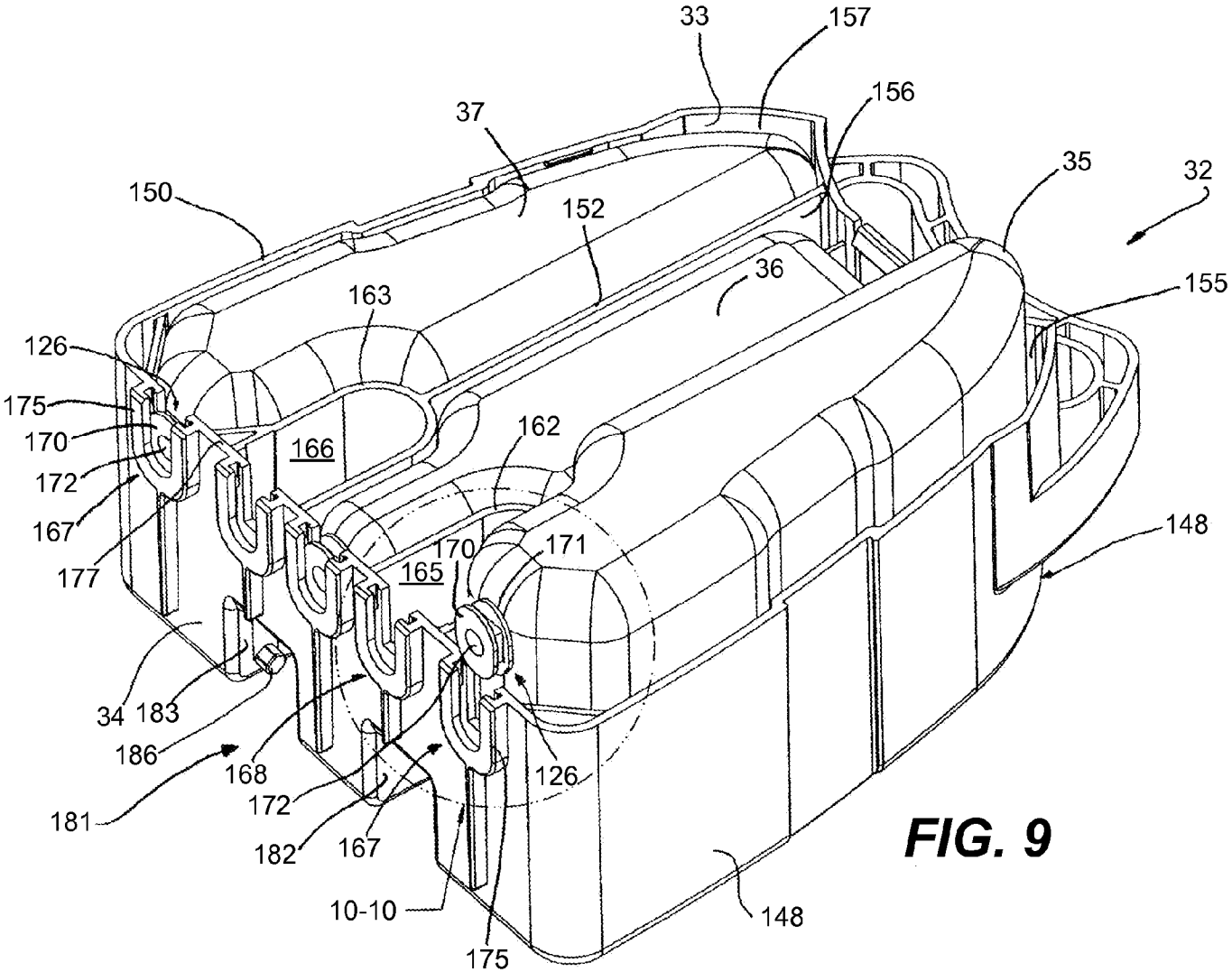
FIG. 9 is an exploded, enlarged bottom perspective view of a cartridge apparatus of FIGS. 5 and 6, illustrating mounting of one of a plurality of reagent containers therein.

Each dividing wall 151, 152 is preferably planar, and is oriented upright when the cartridge apparatus 32 is lying in the orientation of FIG. 9. Moreover, the dividing walls are preferably integrally formed with the interior walls defining the cavity 33, and extend fully from the rear wall 146 of the body member 145 to the front wall 34 thereof. Further, the dividing walls extend all the way to a top wall 160 of the body member 145, effectively separating the adjacent first, second and third compartments 155-157 from one another. This is beneficial in that it adds structural rigidity and isolates one compartment from another.

As best viewed in FIG. 6, the dividing walls 151, 152 also extend in a direction substantially perpendicular to the front wall 34 and the rear wall. Together with the webbed support walls 161, this configuration provides ample load bearing support to the front wall 34 that is necessary when cartridge apparatus 32 is mounted to the docking assembly 38. As will be described, during engagement of the dock connectors 125 and the corresponding collared connectors 126, over fifty (50) lbs of force may be sustained against the front wall. Hence, the front wall 34 must be sufficiently reinforced to resist material fatigue and potential material fracture or significant deflection during the make or break of the connectors.

It will be appreciated that while two primary dividing walls 151, 152 are described and shown, more dividing walls could be added that define more than three primary compartments. In fact, as shown in FIGS. 6 and 9, each dividing wall 151, 152 is Y-shaped at a pocket portion 162, 163 thereof. Each pocket portion 162, 163 is oriented at one end of the respective dividing wall 151, 152, and that intersects the front wall 34 to form a respective pocket compartment 165, 166. As shown, a first pocket compartment 165 is formed and positioned between the first compartment 155 and the second compartment 156, while a second pocket compartment 166 is formed and positioned between the second compartment 156 and the third compartment 157. Each pocket compartment 165, 166 is significantly smaller in volume than the primary compartments 155-157. However, in a similar manner, these pocket compartments are formed and dimensioned for receipt of a respective reagent container (not shown) therein for liquid dispensing.

Figure 10:
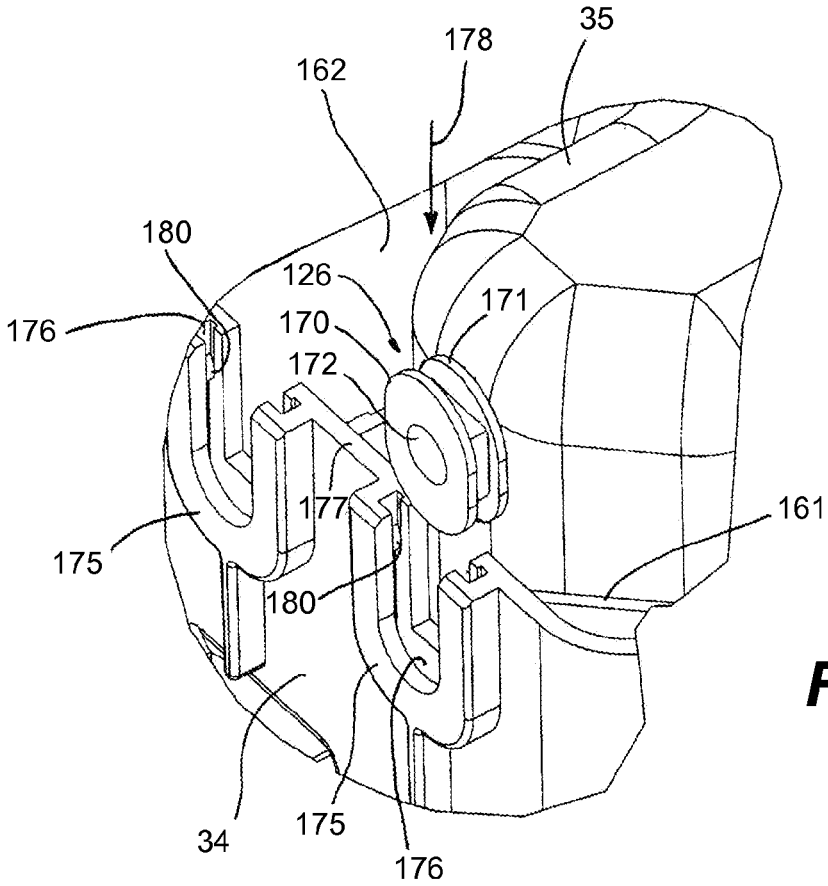
FIG. 10 is an exploded, enlarged bottom perspective view of the cartridge apparatus, taken along the line of the circle 10-10 of FIG. 9.

As best illustrated in FIGS. 9 and 10, each primary compartment 155-157 and each pocket compartment 165, 166 includes a corresponding primary connector support 167 and pocket connector support 168, respectively, coupled to the front wall 34 for communication with the respective pocket compartment 165, 166 and the primary compartment 155-157, respectively. Briefly, it will be appreciated that while the primary connector support 167 and the pocket connector supports 168 are illustrated, only the primary connector supports and the associated reagent containers 35-37, etc. will be detailed for the ease of description and clarification.

Accordingly, each connector support 167 is formed and dimensioned for sliding engagement with a respective collared connector 126 of the respective reagent container therebetween. FIGS. 10, 11B and 11C illustrate that each connector support 167 cooperates with the respective collared connector 126 to provide a predetermined tolerance or longitudinal sliding displacement therebetween to aid engagement with the respective dock connector 125.

The collared connectors 126, only one of which will be described in detail, each include an outer collar portion 170 and an adjacent inner collar portion 171 surrounding a respective receiving receptacle 172 of the connector. These substantially parallel, oval-shaped collars are preferably composed of semi-flexible thermoplastic material, and are removably press-fit into mounting engagement with a respective connector support 167 (FIG. 10).

Briefly, these conventional female collared connectors 126 and the mating male dock connectors 125 are typically referred to as multiple make and break style fluid connectors, and are often applied to food product packaging. The receiving receptacle 172 of the collared connector 126 is formed and dimensioned for sliding receipt of the corresponding pin portion 127 of the dock connector 125.

Figure 11A:
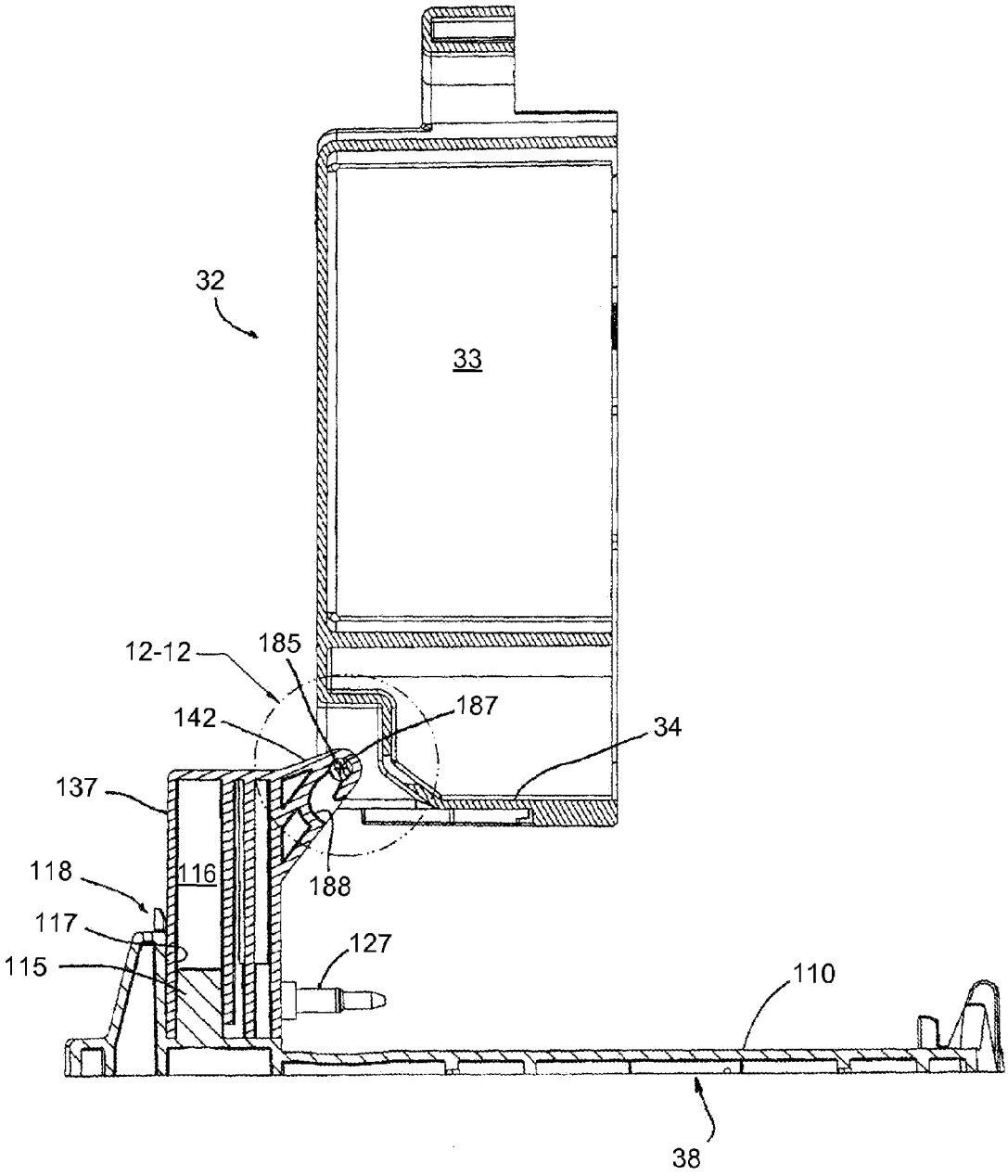
FIGS. 11A-11C is a series of enlarged side elevation views, in cross-section, of the cartridge apparatus and docking assembly of FIG. 5, and illustrating movement of the cartridge apparatus between the opened first condition and the closed second condition.
Figure 11B:
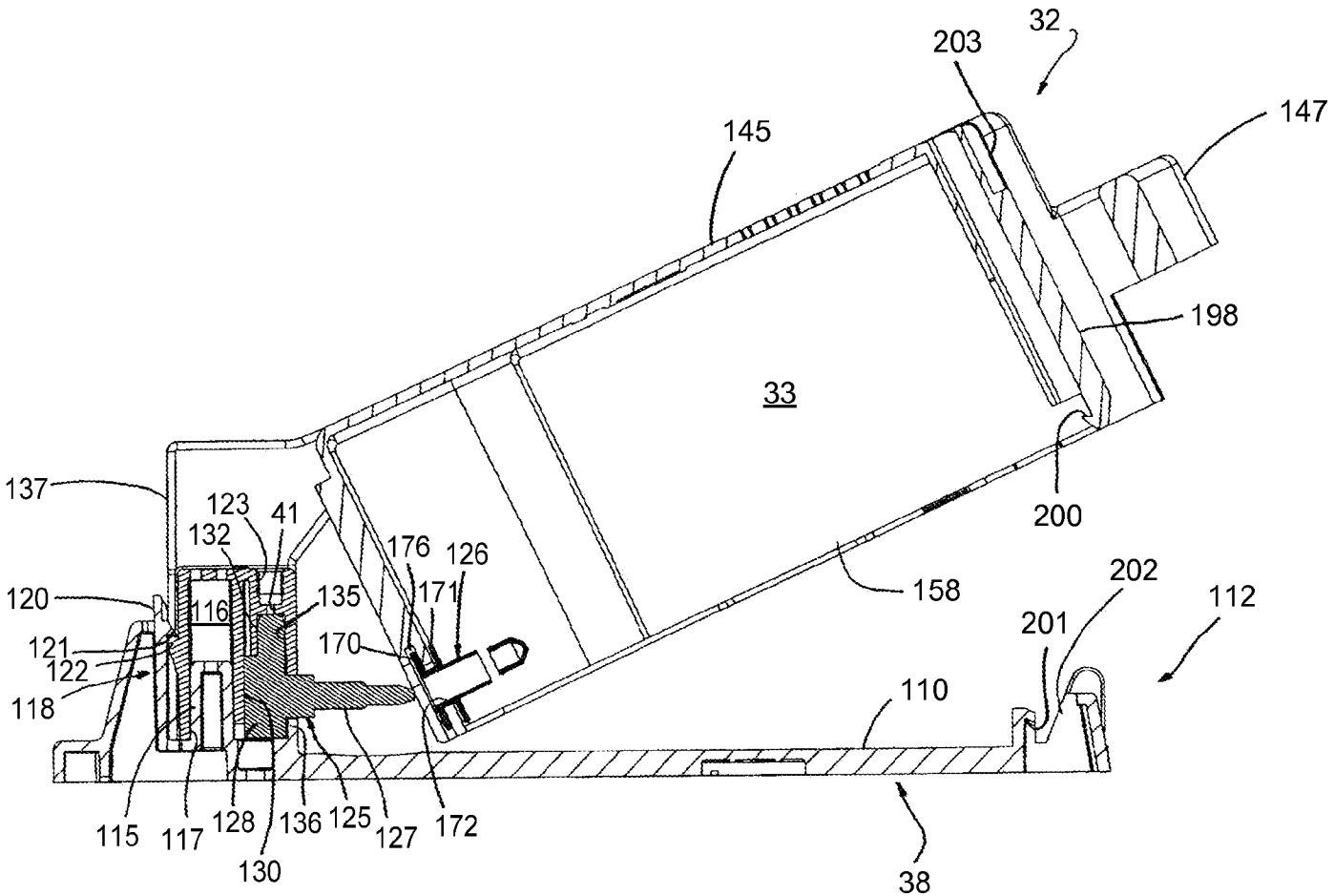
Figure 11C:
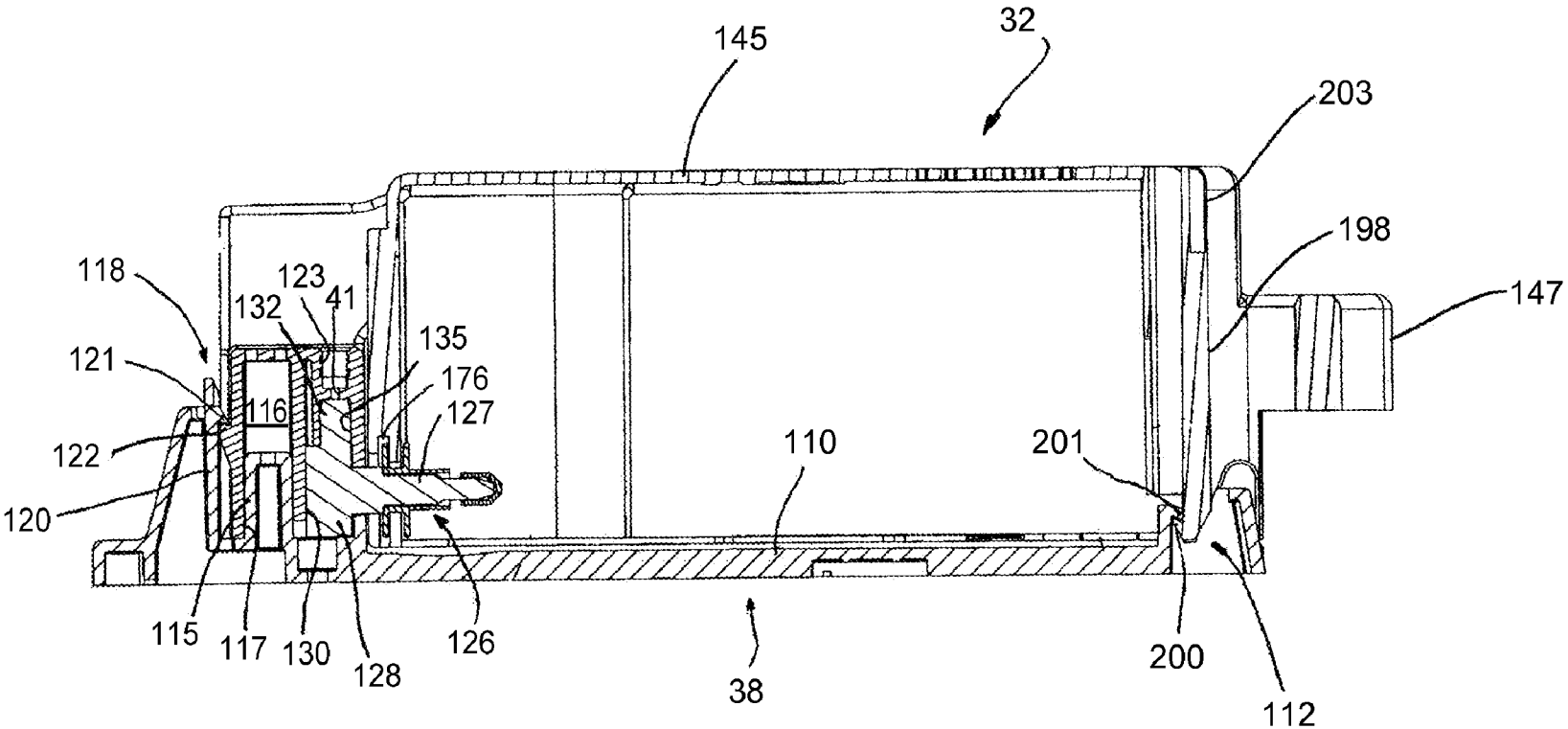

To promote fluid sealing, as shown in FIGS. 6 and 11A, the pin portions include O-rings 173. During insertion of the tapered pin portion 127 into the corresponding receptacle 172, the corresponding O-ring 173 engages the interior walls defining the receiving receptacles to form a fluid tight seal therebetween. Typical of these male dock connectors 125 are those provided by IPNUSA of Peachtree City, Ga. Model No. SPS-4 Similarly, the mating female collared connectors 126 are also those provided by IPNUSA Model No. SPS-4F It will be appreciated, however, that other IPNUSA style multiple make and bread fluid connectors can be utilized.

Referring back to FIGS. 9 and 10, each connector support 167 includes a U-shaped load bearing support 175 that cooperates with the front wall 34 to define a U-shaped groove 176 therebetween. The U-shaped grooves 176 extend downwardly from a lower edge portion 177 of the front wall 34, and are formed for sliding receipt of the respective outer collar portion 170 of a respective collared connector 126 therein, in the direction of arrow 178. Similarly, the respective inner collar portion 171 is retained against the interior side of the front wall for additional support.

To retain the collared connector 126 in the groove 176, the connector support 167 includes a pair of opposed retention tangs 180 (only one of which can be seen) extending into a respective groove 176 thereof. As the reagent container 35 is positioned in the respective primary compartment 155, and the outer collar portion 170 is inserted into the respective groove 176, the peripheral sides of the collar will friction contact the retention tangs 180. Manually applying a sufficient force, in the direction of arrow 178, the friction force between the opposed retention tangs 180 and the outer collar portion 170 can be overcome to force the collared connector 126 past the retention tangs 180 and into a socket of the U-shaped groove 176. Conversely, to remove the retained collared connectors, a force applied in a direction opposite that of arrow 178 must similarly overcome the opposed frictional forces for removal from the connector support.

The collared connectors 126 are each mounted, in a fluid-tight manner, to one end of the corresponding reagent container 35-37. Each container 35-37 is formed and dimensioned for placement into a respective primary compartment 155-157 (FIG. 9). Hence, in some specific embodiments, the containers may be provided by a collapsible, flexible-type plastic bag that are capable of semi-conforming to the shape of the respective compartment in which it is contained. For example, the application of thin plastic bags are typically more cost effective, and need not be vented as the plastic bag will collapse as the liquid reagent is drawn from the bag.

Figure 13:
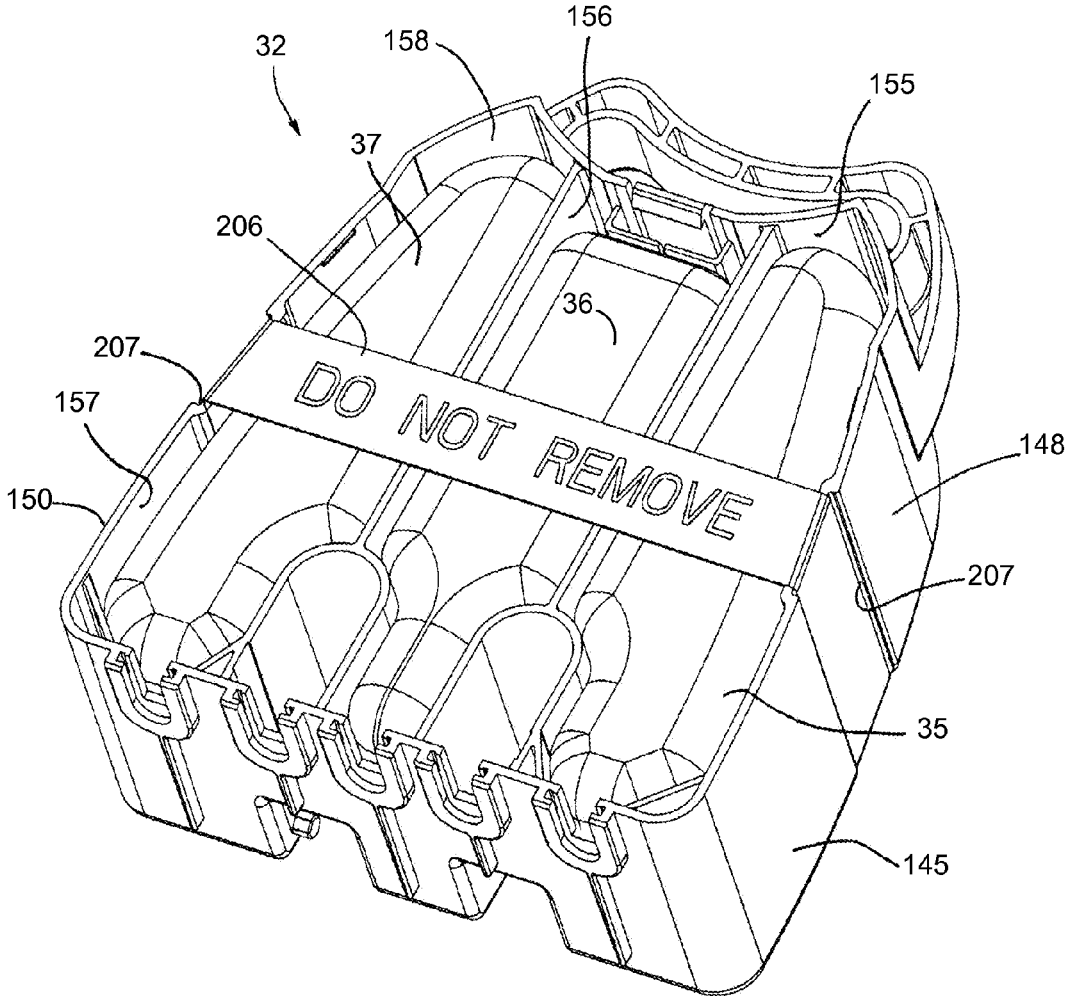
FIG. 13 is an enlarged bottom perspective view of an alternative embodiment transportable cartridge apparatus.

In another specific embodiment, the reagent containers 35-37 may more rigid and custom pre-shaped for positioning in the respective primary compartments 155-157 (as shown in FIGS. 9 and 13, for instance). Such custom preformed containers may facilitate volume maximization of the containers in the respective compartment. The may also be more protective, if desired, since the rigidity and wall thickness can be increased.

To moveably mount the cartridge apparatus 32 to the docking assembly 38, the cartridge apparatus includes a mounting device 181 that cooperates with the dock mounting structure 140. FIGS. 5, 9 and 11 illustrate that the cartridge mounting device 181 is integrally formed with the body member 145. More specifically, the cartridge mounting device 181 is configured to cooperate with the mounting posts 142, 143 of the docking assembly 38 for movement between a first condition (FIG. 11A) and a second condition (FIGS. 5 and 11C). Briefly, in the first condition, the cartridge mounting device 181 and the dock mounting structure 140 cooperate to enable coupling of the cartridge apparatus 32 to the docking assembly 38. In contrast, during movement of the cartridge apparatus 32 from the first condition to the second condition (FIGS. 11B and 11C), the respective collared connectors 126 of the reagent containers 35-37 are aligned and engaged with the respective dock connectors 125 of the docking assembly 38 for fluid-tight mating therebetween.

The mounting device 181 of the cartridge apparatus is preferably positioned at an outer upper portion of the cartridge apparatus. More preferably, the mounting device 181 includes a pair of spaced-apart post receptacles 182, 183 formed for receipt of the triangular-shaped cantilevered mounting posts 142, 143 of the docking assembly 38 therein (FIGS. 5, 9 and 11A). These receptacles 182, 183 are positioned proximate an intersecting edge between the front wall 34 and the top wall 160 of the body member 145

Figure 12:
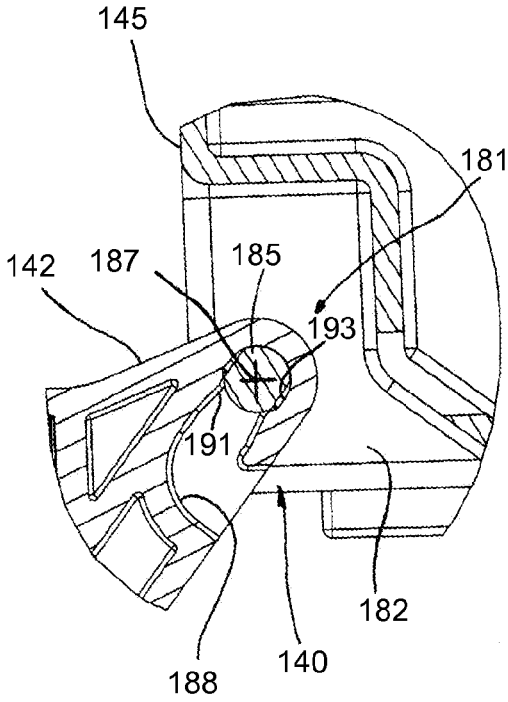
FIG. 12 is an enlarged side elevation view, in cross-section, of a mounting structure of the cartridge apparatus, taken along the line of the circle 12-12 of FIG. 11A.

The cartridge mounting device 181 further includes a pair of opposed hinge pins 185, 186 (FIG. 9, 11A and 12) extending transversely across the post receptacles 182, 183. These pins 185, 186 are preferably longitudinally aligned along a common rotational axis 187 that is oriented substantially at and parallel to the intersecting edge. These hinge pins 185, 186 cooperate with the tapered L-shaped slots 188, 190 (FIGS. 6, 11A and 12) formed in the opposed outer walls 196, 197 of the cantilevered mounting posts 142, 143 to enable hinged movement about the rotational axis 187 between the first condition and the second condition. Each L-shaped slot 188, 190 tapers inwardly towards a neck portion (only neck portion 191 of slot 188 of which is shown) which then terminates at an end socket 193 formed and dimensioned to receive and retain the hinge pin 185 there in for rotation about the rotational axis 187.

To mount the cartridge apparatus 32 to the docking assembly 38, the pair of cantilevered mounting posts 142, 143 are aligned with and place into the corresponding post receptacles 182, 183, in a manner aligning and sliding the cartridge hinge pins 185, 186 into the corresponding L-shaped slots 188, 190 of the mounting posts. As best viewed in FIG. 12, the transverse cross-sectional dimension of the hinge pin 185 (as well as hinge pin 186) is eccentric-shaped. Hence, in the orientation of the first condition shown in FIGS. 11A and 12, the eccentric-shaped hinge pin 185 permits passage through the neck portion 191, 192 and into the end socket 193, 195 of the L-shaped slot 188. Upon movement of the cartridge apparatus toward the second condition, the hinge pins 185, 186 are locked into their corresponding sockets. Conversely, to remove the eccentric hinge pins 185, 186 from the end sockets 193, 195, the cartridge apparatus 32 must be returned to the first condition to push the pins past the corresponding neck portions.

In accordance with the present invention, the dock mounting structure 140 and the cartridge mounting device 181 cooperate such that during movement of the cartridge apparatus from the first condition to the second condition, the respective collared connectors 126 of the reagent containers 35-37 are aligned and engaged with the respective dock connectors 125 of the docking assembly for fluid-tight mating therebetween. As will be apparent, such mating engagement is permitted in part to the predetermined tolerance or longitudinal displacement of the collared connector 126 in the respective socket of the U-shaped groove 176.

As the cartridge apparatus 32 is moved from the first condition (FIG. 11A) toward the second condition (i.e., from FIG. 11B to FIG. 11C), the pin portions 127 of the respective male dock connectors 125 are automatically aligned and inserted through the mating receiving receptacles 172 of the female collared connectors 126 until seated for fluid communication with the respective reagent containers 35-37 at the second condition. However, the movement of the cartridge apparatus 32 relative the docking assembly from the first condition to the second condition is rotational about rotational axis 187. Hence, the actual inter-engagement between the collared connectors 126 and the dock connectors 125 is along a curvilinear path. This is problematic since the selected mating connectors are generally designed for conventional linear engagement along the respective longitudinal axes of the pin portions 127 and respective receiving receptacles 172 thereof.

By allowing collared connectors 126 to longitudinally displace a predetermined tolerance in the respective sockets of the U-shaped grooves 176, in the directions of arrow 178 in FIG. 11B, the pin portions 127 of the dock connectors can be sufficiently aligned with the receiving receptacles 172 of the collared connectors 126 as the cartridge apparatus 32 is urged toward the second condition (FIG. 11C). Preferably, this predetermined tolerance is in the range of about 0.030 inches to about 0.050 inches.

As mentioned, to collectively engage the fluid connectors, up to about fifty (50) lbs. may be required in some instances. Using the handle member 147 of the cartridge apparatus 32, positioned at the rear wall 146, sufficient leverage can be generated to facilitate manual engagement (and disengagement) of the fluid connectors force for most persons. Also located along the rear wall 146 is a latch lever 198 of the cartridge latch assembly 112, above-mentioned. As shown in FIGS. 5, 11B and 11C, the latch assembly 112 cooperates between the cartridge body member 145 and the dock base member 110 to releasably lock the cartridge apparatus 32 to the docking assembly 38.

The latch lever 198 is cantilever mounted at a central portion thereof to the rear wall of the body member 145. At a bottom portion of the latch lever 198 is a latch tang 200 that engages a corresponding lip portion 201 in a latch receiving slot 202 of the base member 110. When the cartridge apparatus 32 is moved to the second condition of FIG. 11C, the resilient latch tang 200 engages the corresponding lip portion 201 to releasably lock the cartridge apparatus in place.

At a top of the latch lever 198 is a manually lever portion 203 that operates the lower latch tang 200. By manually pressing the lever portion 203 in the direction of arrow 205 in FIG. 5, the latch tang 200 can be moved past the lip portion 201 to release the latch lever from the locked position.

In another aspect of the present invention, as shown in FIG. 13, the cartridge apparatus 32 can be distributed with one or more reagent containers 35-37 already preinstalled in the primary compartments 155-157. In this specific embodiment, the cartridge apparatus 32 is then ready for easy mounting to the docking assembly 38, and connection to the liquid dispensing system through the dock manifold.

To secure the reagent containers 35-37 in the cartridge apparatus 32 for transport, a strap device 206 may be provided that extends across the opening 158 into the interior cavity 33. Preferably, this strap device 206 extends transverse to the first and second dividing walls 151, 152, and across the compartments 155-157. The strap device may be composed of any flexible heat shrink material. Typical of such flexible materials include polyethylene.

To further secure and retain the strap device 206 in place, the exterior portions of the body member 145 may include an alignment groove 207 or the like. These alignment grooves 207 are preferably positioned on opposing sidewalls 148, 150 of the body member 145, and are formed and dimensioned for receipt of the strap device therein. When the strap device is tightened about the cavity opening 158 the alignment grooves 207 will prevent slippage about the body member 145.

In still another aspect of the present invention, the general operation of the liquid dispensing system 30 of the present invention is disclosed. Referring to the self-explanatory operation flow diagrams of FIGS. 14A-14G, FIG. 14A illustrates the start-up procedure. Upon power-up, the control circuit board 61 establishes communication with the user interface 71 through the power and control cord 66. System configuration is then retrieved from an internal non-volatile memory device, or in the absence of that information, the user is instructed to enter it. If the cartridge 32 is empty, the user is instructed to replace it with a new one. The control circuit board 61 will next position the pump device 62 and the valve assembly 55 to their start-up positions.

Figure 14A:
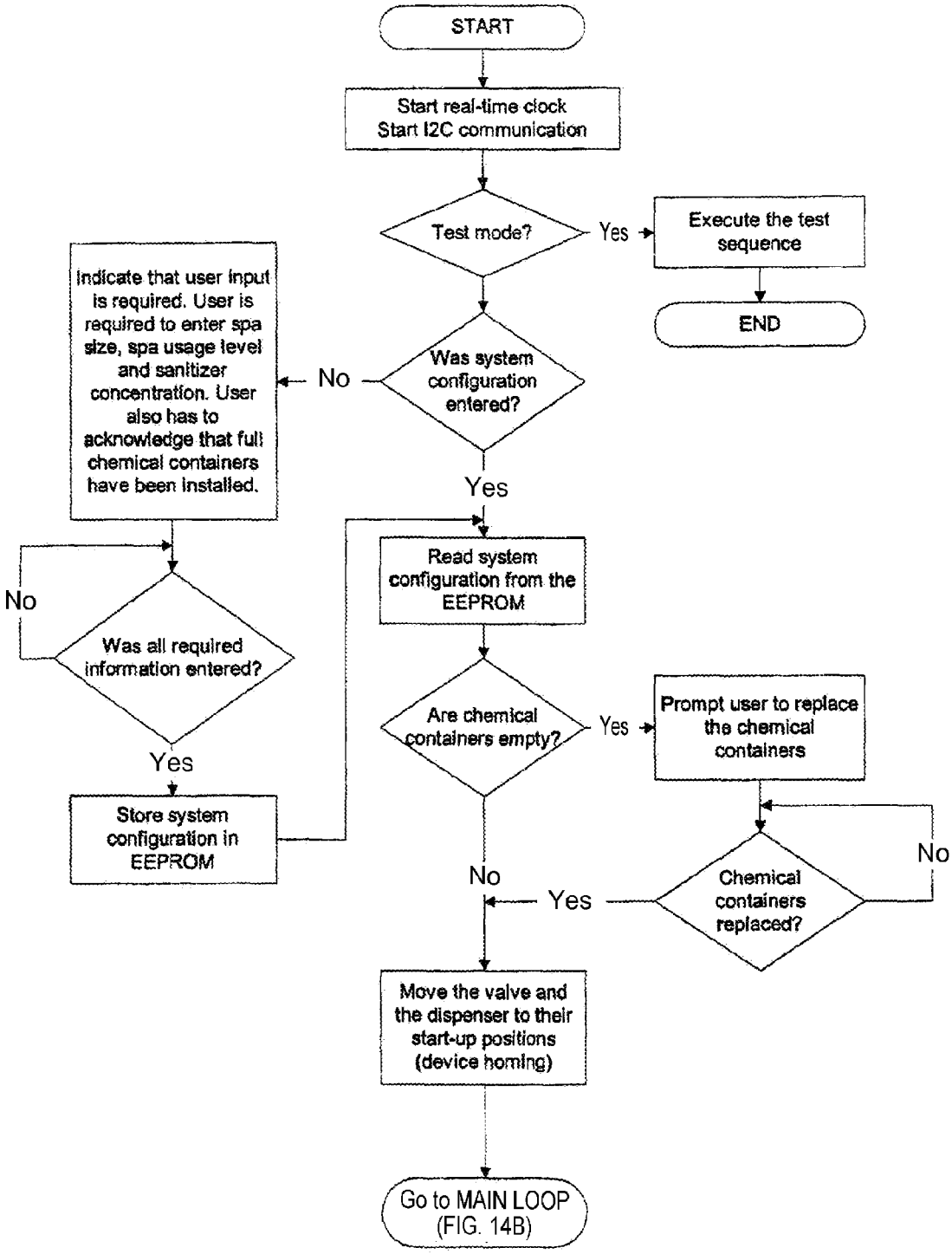
FIGS. 14A-14G is a series of flow diagrams illustrating the operational method of the liquid dispensing system of FIGS. 1 and 2 constructed in accordance with the present invention.
Figure 14B:
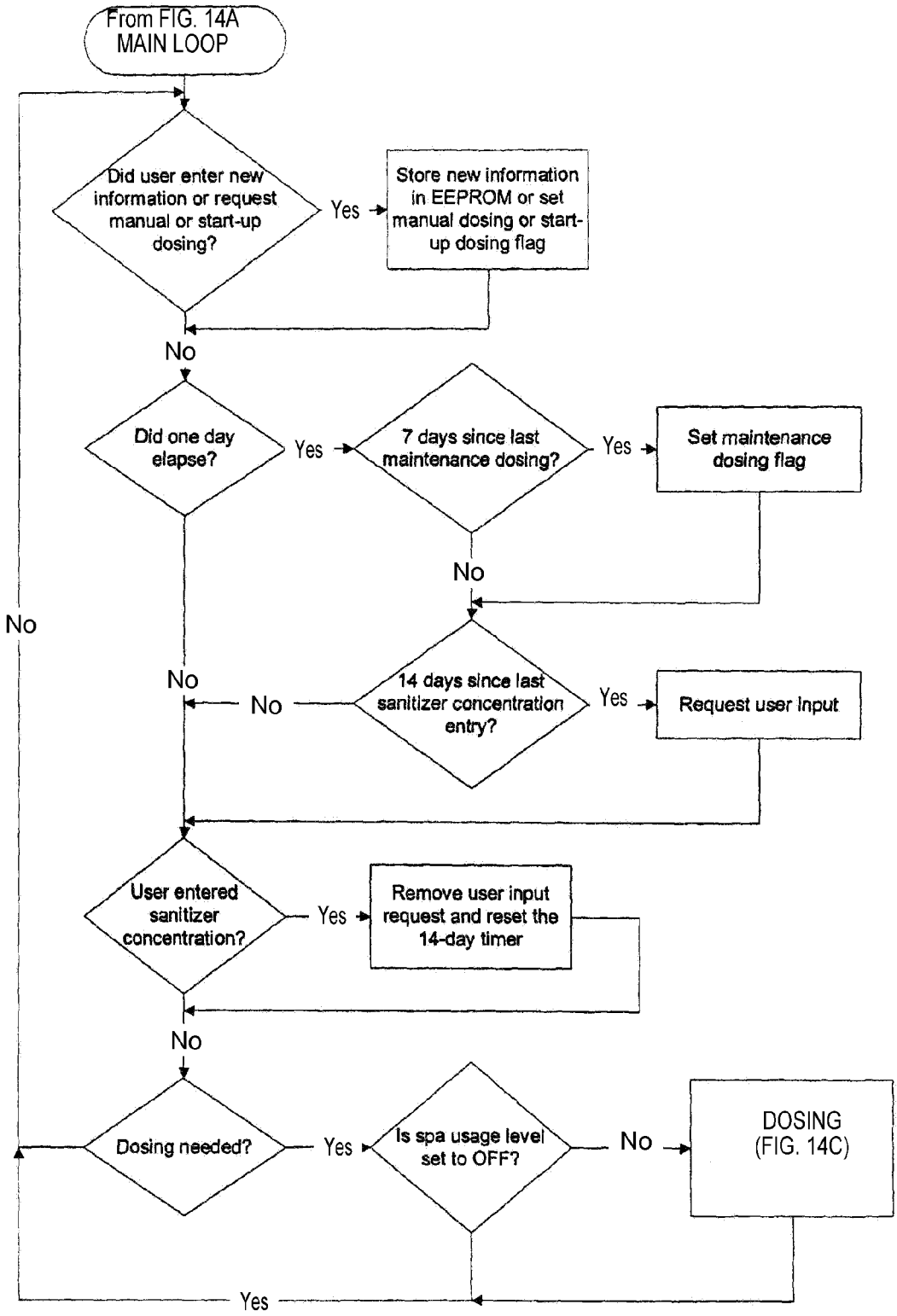

FIG. 14B illustrates the main operational loop of the dosing engine 45. Dosing of liquid reagents can be a result of a user request or an automatic, timed schedule. Upon encountering either a user request or an indication from an internal timer, the dosing engine 45 will dispense the liquid reagents from the cartridge 32 into the spa 59 using a dosing schedule stored in the internal non-volatile memory of the control circuit board 61. Another internal timer is used to track the frequency of the user inputting the concentration of liquid reagents in the spa 59. If the predetermined period of time has passed without user input, the user is instructed to perform the measurement of liquid reagent levels in spa 59, and to enter the values using user interface 71.

Figure 14C:
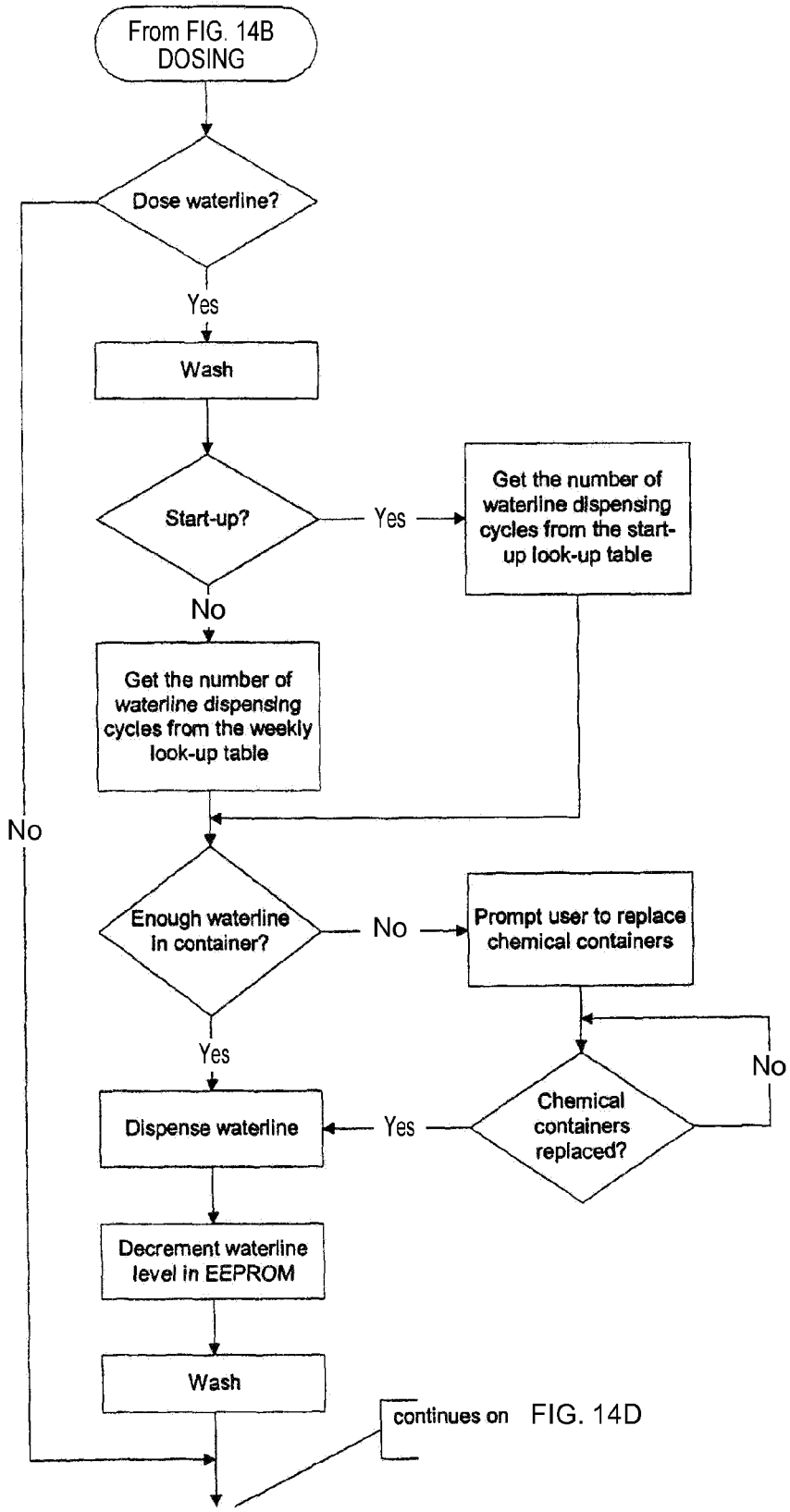
Figure 14D:
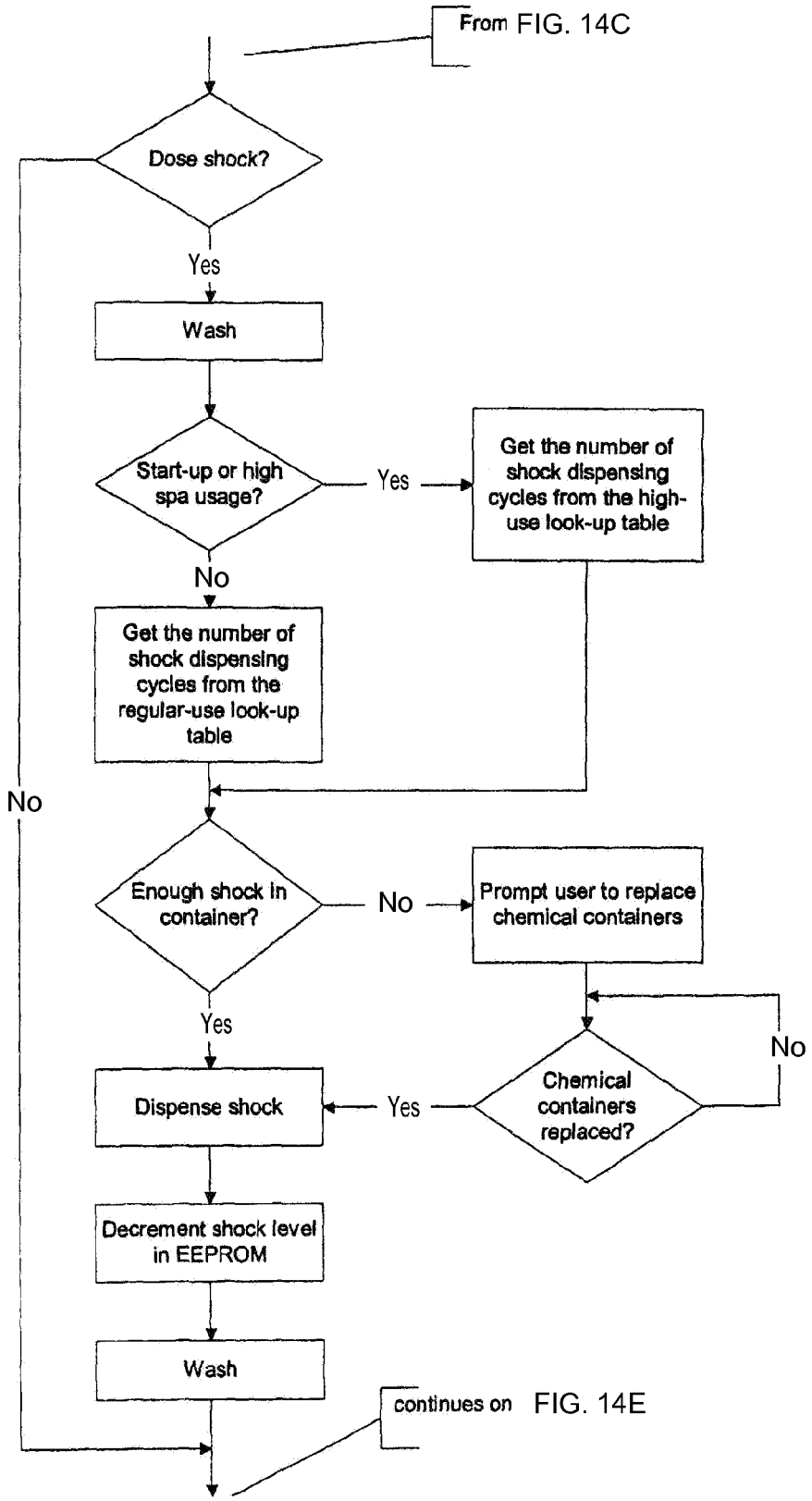
Figure 14E:
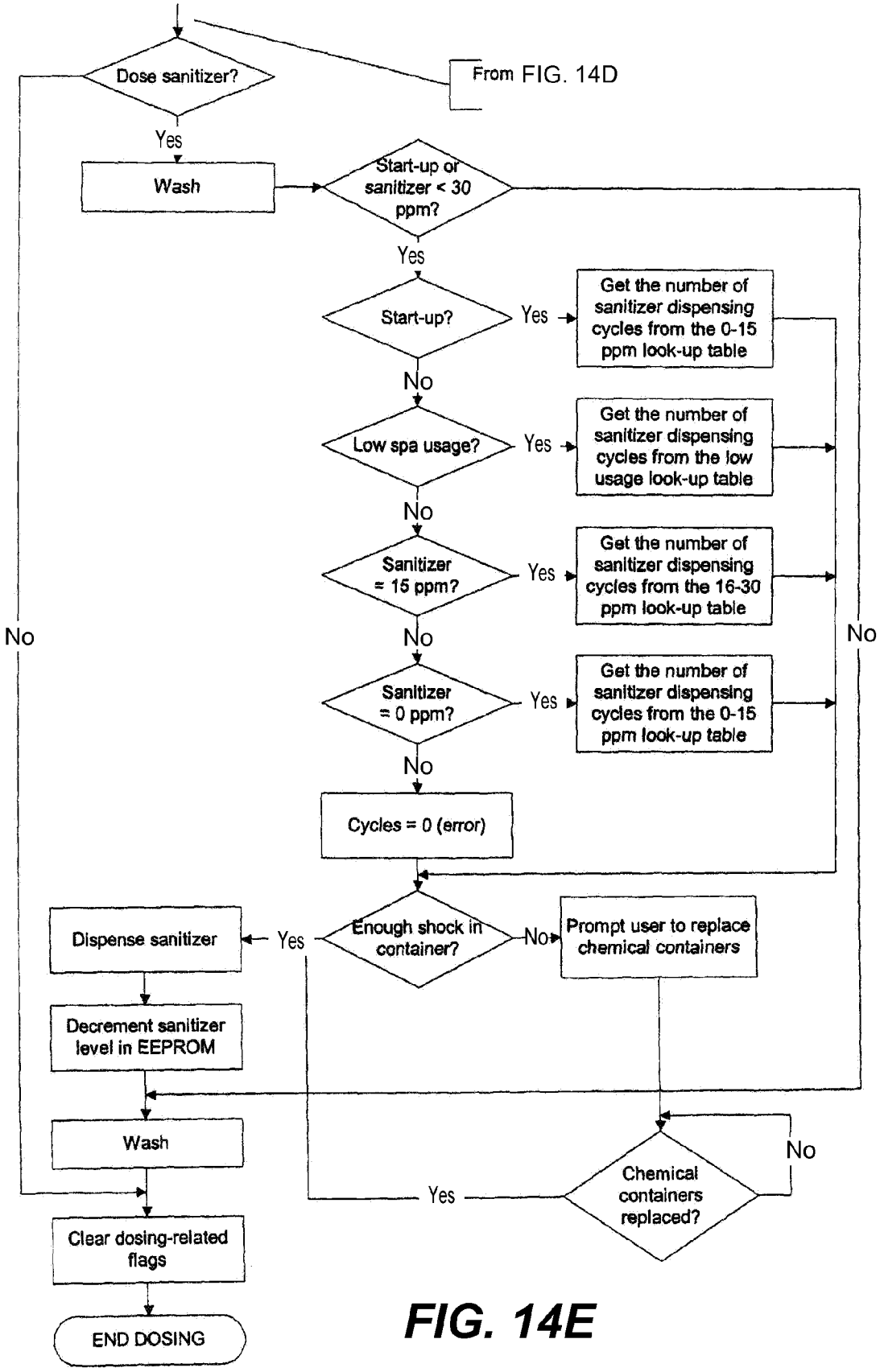
Figure 14F:
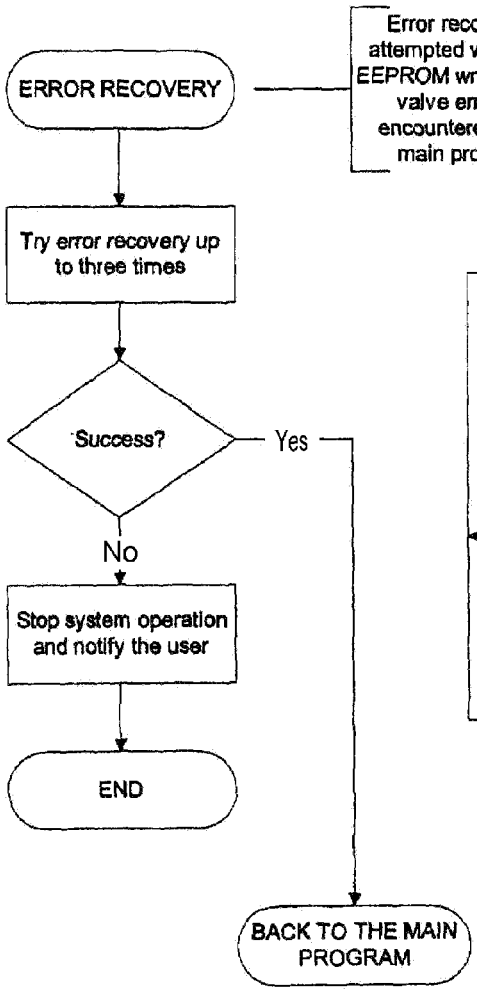
Figure 14G:
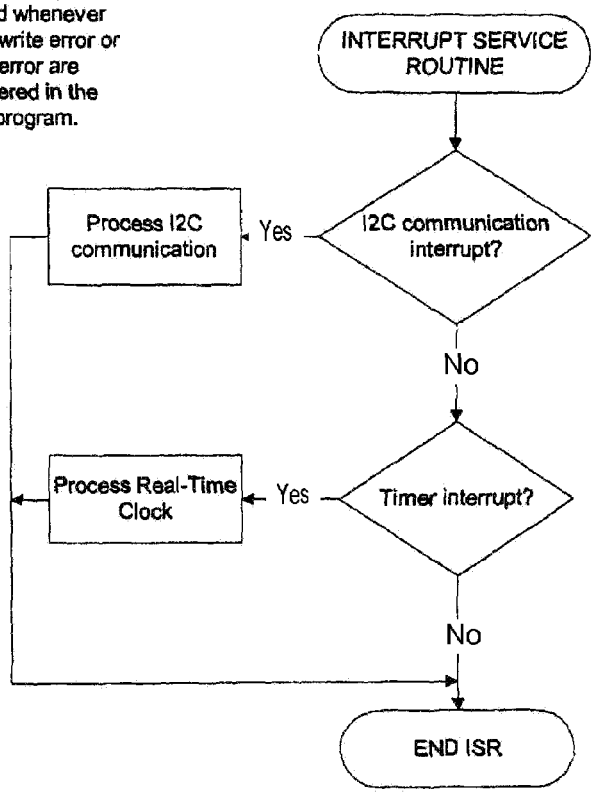

Dispensing algorithms for different types of liquid reagents are also stored in the internal non-volatile memory of the control circuit board 61, and are illustrated in FIGS. 14C, 14D, and 14E. FIG. 14F depicts the procedure used when a system error is encountered, while FIG. 14G illustrates the operation of the control circuit board 61 interrupt system for accomplishing communication and timing tasks.

Those skilled in art will appreciate that other possible modes of system operation can accomplish the essentially same liquid dispensing tasks. Moreover, although only a few embodiments of the present inventions have been described in detail, it should be understood that the present inventions might be embodied in many other specific forms without departing from the spirit or scope of the inventions.

What is claimed is:

1. A liquid dispensing system for automated dispensing of one or more liquid reagents into a recreational body of water, said system comprising:

a cartridge apparatus defining a cavity, and a cartridge front wall;

one or more liquid reagent containers containing a respective liquid reagent, each said reagent container being disposed in said cavity in a manner permitting access to each respective liquid reagent through the front wall;

a docking assembly having a dock manifold device, and releasably coupled to the cartridge apparatus between a first condition and a second condition, removably mounting the cartridge apparatus to the docking assembly in a manner permitting fluid communication through the cartridge front wall from the respective reagent container to respective fluid passages of the manifold device;

a dosing engine having a valve manifold device having one or more intake ports coupled to the respective dock manifold fluid passages, and a dispensing port to deliver the liquid reagents to the body of water, said dosing engine further including a valve assembly fluidly coupled to the valve manifold device to manipulate the flow distribution between the respective intake ports and the dispensing port for selective dispensing of the respective liquid reagents through the dispensing port and to the recreational body of water.

2. The liquid dispensing system as defined by claim 1, wherein:

said dosing engine includes a pump device in fluid communication with the manifold device to pump the liquid reagents out of said dispensing port.

3. The liquid dispensing system as defined by claim 2, further including:

a control system operably coupled between the switching valve and the pump device for automated control thereof.

4. The liquid dispensing system as defined by claim 2, wherein said valve manifold device includes a stator element defining one or more intake passages fluidly coupled to a corresponding reagent reservoirs and having one or more intake-ports terminating at a stator face lying in an interface plane, said stator element further defining a dispensing passage fluidly coupled to the dispensing port which terminates at the stator face, and a central passage having one portion fluidly coupled to the pump device and another portion fluidly coupled to a drive port that terminates at the stator face; and said valve assembly including a rotor element defining a rotor face oriented in the interface plane in opposed relationship to and contacting said stator face in a fluid-tight manner, said rotor element being rotatably movable about a rotational axis, relative to said stator face, for rotational movement of said rotor face to at least a discrete first aspirate and dispense position, wherein, said rotor face and said stator face cooperatively defining a channel such that:

in the first aspirate position, said channel fluidly couples a selected one of the one or more intake ports and the drive port; and in the dispense position, said channel fluidly couples the dispensing port and the drive port.

5. The liquid dispensing system as defined by claim 4, further including:

a fluid containment reservoir, having a discrete volume, in fluid communication with the drive port and the pump device for the containment of liquid reagent therein.

6. The liquid dispensing system as defined by claim 5, wherein in the first aspirate position, a discrete volume of liquid reagent from the one reagent reservoir can be aspirated, via the pump device, through the selected one intake port, the drive port and into the containment reservoir; and in the dispense position, the discrete volume of liquid reagent contained in the containment reservoir can be dispensed therefrom, via the pump device, through the drive port and out of the dispensing port.

7. The liquid dispensing system as defined by claim 6, wherein said stator element further defining a wash passage having one portion configured to fluidly couple to a wash reservoir containing a wash fluid, and another portion fluidly coupled to a wash port that terminates at the stator face; and said rotor element further being rotatably movable to at least a discrete wash position, wherein the channel fluidly couples said wash port and the drive port, to enable said pump device to aspirate wash fluid through the wash port, the drive port and into the containment reservoir.

8. The liquid dispensing system as defined by claim 5, wherein, said pump device includes a pump barrel defining a cavity, and containing a reciprocating piston therein, said cavity and said reciprocating piston cooperating to define a substantial portion of the fluid containment reservoir.

9. The liquid dispensing system as defined by claim 4, wherein said pump device further includes a linear stepper motor coupled to said reciprocating piston for accurate volumetric actuation thereof.

10. The liquid dispensing system as defined by claim 8, wherein said pump barrel is angled during operation thereof in a manner creating an apex portion in said cavity, said pump barrel containing an offset pump port extending into said apex portion to facilitate purging thereof.

11. The liquid dispensing system as defined by claim 1, wherein, said docking assembly includes mounting structure and one or more dock connectors in fluid communication with the manifold device, each respective reagent container includes a collared connector enabling access to the respective reagent contained therein, each said collared connector being formed for mating engagement with a respective dock connector for fluid communication therebetween, and said cartridge apparatus including:

a body member defining the central cavity therein, and said front wall;

one or more dividing walls separating the central cavity into at least two or more adjacent compartments, each compartment being sized and dimensioned for receipt and support of a respective reagent container therein;

one or more connector supports coupled to said front wall for communication with the respective compartment, and each connector support being formed and dimensioned for sliding engagement with a respective collared connector therebetween to enable receipt and support of the respective reagent container in the respective compartment, each said connector support cooperating with the respective collared connecter to provide a predetermined amount of sliding longitudinal movement therebetween; and a mounting device coupled to the body member, and configured to cooperate with the docking assembly mounting structure for movement of the cartridge apparatus between the first condition and a second condition, wherein during movement of the cartridge apparatus from said first condition to said second condition, the respective collared connectors of the reagent containers, slideably mounted to the respective connector support, are aligned and engaged with the respective dock connector of the docking assembly for fluid-tight mating therebetween.

12. The liquid dispensing system as defined by claim 11, wherein said mounting device and said mounting structure cooperate for hinged movement of the cartridge apparatus relative the manifold device, between the first condition and the second condition, such that an engagement between the respective collared connectors of the associated reagent container and the respective dock connectors is a curvilinear motion.

13. The liquid dispensing system as defined by claim 12, wherein said mounting device includes a hinge pin, and said mounting structure includes a hinge slot formed and dimensioned for sliding receipt of said hinge pin to a locking position, releasably locking the mounting device to the mounting structure, and enabling hinged movement of the cartridge apparatus about a rotational axis of the hinge pin between the first condition and the second condition.

14. The liquid dispensing system as defined by claim 11, wherein each connector support includes a U-shaped groove extending downwardly from a lower edge portion of the front wall, and formed for sliding receipt of the respective collared connector therein.

15. The liquid dispensing system as defined by claim 14, wherein each second connector support includes a first tang and an opposed second tang extending into a respective groove thereof, the first and second tangs cooperating with the respective collar connectors to retain the collar connector in the respective groove.

16. The liquid dispensing system as defined by claim 14, wherein a respective bight portion of the U-shaped groove and the respective first and second tangs cooperate to permit sliding movement of the respective collar connector in the range of about 0.030 inches to about 0.050 inches.

17. The liquid dispensing system as defined by claim 11, wherein said one or more dividing walls each further cooperating with the body member to define one or more pocket compartments proximate to the front wall, and positioned between adjacent compartments, each pocket compartment being formed and dimensioned for receipt of a respective reagent container therein, said apparatus further including:

one or more pocket connector support coupled to said front wall for communication with a respective pocket compartment, each said pocket connector support being formed and dimensioned for sliding engagement with a respective collared connector therebetween to enable receipt and support of the reagent container in the pocket compartment, said pocket connector support cooperating with the respective collared connecter to provide a predetermined amount of sliding longitudinal movement therebetween, wherein during movement of the cartridge apparatus from said first condition to said second condition, the respective collared connector of the reagent containers, slideably mounted to the pocket connector support, is aligned and engaged with the respective dock connector of the docking assembly for fluid-tight mating therebetween.

18. A liquid dispensing system for dispensing of a plurality of liquid reagents, each contained in a separate respective reagent container, and each including a collared connector, said dispensing system comprising:

a docking assembly having a manifold device configured to distribute liquids therethrough, said docking assembly including mounting structure and a plurality of dock connectors in fluid communication with the manifold device;

a cartridge apparatus including:

a body member defining a central cavity therein, and having a front wall;

a first dividing wall separating the central cavity into a first compartment and an adjacent second compartment, each of the first and second compartment being sized and dimensioned for receipt and support of a respective reagent container therein; and a first and second connector support coupled to said front wall for communication with the respective first and second compartment, and each said first and second connector support being formed and dimensioned for sliding engagement with a respective collared connector therebetween to enable receipt and support of the respective reagent container in the respective first and second compartment, said first and second connector support cooperating with the respective collared connecter to provide a predetermined amount of sliding longitudinal movement therebetween; and a mounting device coupled to the cartridge apparatus, and configured to cooperate with the docking assembly mounting structure for movement of the cartridge apparatus between a first condition and a second condition, removably mounting the cartridge apparatus to the docking assembly, wherein during movement of the cartridge apparatus from said first condition to said second condition, the respective collared connectors of the reagent containers, slideably mounted to the respective first and second connector support, are aligned and engaged with the respective dock connector of the docking assembly for fluid-tight mating therebetween.

19. The liquid dispensing system as defined by claim 18, wherein each said dock connector includes an elongated pin portion, and each said collared connector includes a receptacle formed and dimensioned for receipt of a corresponding pin portion therein when the cartridge apparatus is moved to the second condition.

20. The liquid dispensing system as defined by claim 18, wherein said docking assembly includes a base member, and said manifold device upstands therefrom.

21. The liquid dispensing system as defined by claim 20, wherein each said dock connector includes an elongated pin portion extending outwardly from said manifold device in a direction generally parallel to the base member, and each said collared connector includes a receptacle formed and dimensioned for receipt of a corresponding pin portion therein when the cartridge apparatus is moved to the second condition.

22. The liquid dispensing system as defined by claim 21, wherein said mounting device and said mounting structure cooperate for hinged movement of the cartridge apparatus relative the manifold device, between the first condition and the second condition, such that an engagement between the respective collared connectors of the associated reagent container and the respective dock connectors is a curvilinear motion.

23. The liquid dispensing system as defined by claim 22, wherein said mounting device includes a hinge pin, and said mounting structure includes a hinge slot formed and dimensioned for sliding receipt of said hinge pin to a locking position, releasably locking the mounting device to the mounting structure, and enabling hinged movement of the cartridge apparatus about a rotational axis of the hinge pin between the first condition and the second condition.

24. The liquid dispensing system as defined by claim 23, wherein said hinge pin is eccentric-shaped such that in the cartridge apparatus is oriented in the first condition, relative the docking station, the hinge pin may be released from the hinge slot.

25. The liquid dispensing system as defined by claim 23, wherein the rotational axis of the mounting device is positioned proximate a plane containing said front wall.

26. The liquid dispensing system as defined by claim 20, further including:

a latch assembly cooperating between the body member and the base member, in the second condition, to releasably lock the cartridge apparatus to the docking assembly.

27. The liquid dispensing system as defined by claim 26, wherein said latch assembly includes a lever member movably mounted to an exterior wall of the body member, and a receiving slot formed and dimensioned for releasable engagement with a distal portion of the lever member when in the second condition.

28. The liquid dispensing system as defined by claim 18, wherein said first dividing wall further cooperating with the body member to define pocket compartment proximate to the front wall, and positioned between the first compartment and the second compartment, said pocket compartment being formed and dimensioned for receipt of a respective reagent container therein, said apparatus further including:

a pocket connector support coupled to said front wall for communication with the pocket compartment, said pocket connector support being formed and dimensioned for sliding engagement with a respective collared connector therebetween to enable receipt and support of the reagent container in the pocket compartment, said pocket connector support cooperating with the respective collared connecter to provide a predetermined amount of sliding longitudinal movement therebetween, wherein during movement of the cartridge apparatus from said first condition to said second condition, the respective collared connector of the reagent containers, slideably mounted to the pocket connector support, is aligned and engaged with the respective dock connector of the docking assembly for fluid-tight mating therebetween.

29. A liquid dispensing system for automated dispensing of one or more liquid reagents from one or more corresponding reagent reservoirs into a recreational body of water, said system comprising:

a valve manifold device having one or more intake ports, each said reagent reservoir fluidly coupled to a respective intake port, and a dispensing port in fluid communication with the recreational body of water;

a valve assembly movable between a plurality of discrete positions between the intake ports and the dispensing port for selective dispensing of the liquid reagents through the dispensing port and to the recreational body of water;

a docking assembly having a dock manifold device configured to distribute liquids therethrough, said dock manifold device including one or more dock connectors in fluid communication with a corresponding intake port of the valve manifold device; and a cartridge apparatus removably mounted to the docking assembly, and configured to contain the one or more liquid reagent reservoirs therein, each said liquid reagent reservoir fluidly coupled to a respective dock connector.

30. The liquid dispensing system as defined by claim 29, further including:

a pump device in fluid communication with the valve manifold device to pump the liquid reagents out of said dispensing port.

31. The liquid dispensing system as defined by claim 30, further including:

a control system operably coupled between the valve assembly and the pump device for automated control thereof.

32. The liquid dispensing system as defined by claim 30, wherein said valve manifold device includes a stator element defining one or more intake passages fluidly coupled to a corresponding reagent reservoir and having one or more intake-ports terminating at a stator face lying in an interface plane, said stator element further defining a dispensing passage fluidly coupled to the dispensing port which terminates at the stator face, and a central passage having one portion fluidly coupled to the pump device and another portion fluidly coupled to a drive port that terminates at the stator face; and said valve assembly including a rotor element defining a rotor face oriented in the interface plane in opposed relationship to and contacting said stator face in a fluid-tight manner, said rotor element being rotatably movable about a rotational axis, relative to said stator face, for rotational movement of said rotor face to at least a discrete first aspirate and dispense position, wherein, said rotor face and said stator face cooperatively defining a channel such that:

in the first aspirate position, said channel fluidly couples a selected one of the one or more intake ports and the drive port; and in the dispense position, said channel fluidly couples the dispensing port and the drive port.

33. The liquid dispensing system as defined by claim 32, further including:

a fluid containment reservoir, having a discrete volume, in fluid communication with the drive port and the pump device for the containment of liquid reagent therein.

34. The liquid dispensing system as defined by claim 33, wherein in the first aspirate position, a discrete volume of liquid reagent from the one reagent reservoir can be aspirated, via the pump device, through the first intake port, the drive port and into the containment reservoir; and in the dispense position, the discrete volume of liquid reagent contained in the containment reservoir can be dispensed therefrom, via the pump device, through the drive port and out of the dispensing port.

35. The liquid dispensing system as defined by claim 34, wherein said stator element further defining a wash passage having one portion configured to fluidly couple to a wash reservoir containing a wash fluid, and another portion fluidly coupled to a wash port that terminates at the stator face; and said rotor element further being rotatably movable to at least a discrete wash position, wherein the channel fluidly couples said wash port and the drive port, to enable said pump device to aspirate wash fluid through the wash port, the drive port and into the containment reservoir.

36. The liquid dispensing system as defined by claim 33, wherein, said pump device includes a pump barrel defining a cavity, and containing a reciprocating piston therein, said cavity and said reciprocating piston cooperating to define a substantial portion of the fluid containment reservoir.

37. The liquid dispensing system as defined by claim 36, wherein said pump device further includes a linear stepper motor coupled to said reciprocating piston for accurate volumetric actuation thereof.

38. The liquid dispensing system as defined by claim 36, wherein said pump barrel is angled during operation thereof in a manner creating an apex portion in said cavity, said pump barrel containing an offset pump port extending into said apex portion to facilitate purging thereof.

39. The liquid dispensing system as defined by claim 29, wherein:

said docking assembly including mounting structure; and each respective reagent reservoir including a collared connector enabling access to the respective reagent contained therein, said cartridge apparatus including:

a body member defining a central cavity therein, and having a front wall;

a plurality of connector supports each coupled to said front wall for communication with the central cavity, and each connector support being formed and dimensioned for sliding engagement with a respective collared connector therebetween to enable receipt and support of the respective reagent reservoir in the central cavity, each said connector support cooperating with the respective collared connecter to provide a predetermined amount of sliding longitudinal movement therebetween; and a mounting device coupled to the cartridge apparatus, and configured to cooperate with the docking assembly mounting structure for movement of the cartridge apparatus between a first condition and a second condition, removably mounting the cartridge apparatus to the docking assembly, wherein during movement of the cartridge apparatus from said first condition to said second condition, the respective collared connectors of the reagent reservoirs, slideably mounted to the respective connector support, are aligned and engaged with the respective dock connector of the docking assembly for fluid-tight mating therebetween.

40. The liquid dispensing system as defined by claim 39, wherein said mounting device and said mounting structure cooperate for hinged movement of the cartridge apparatus relative the manifold device, between the first condition and the second condition, such that an engagement between the respective collared connectors of the associated reagent reservoir and the respective dock connectors is a curvilinear motion.

41. A liquid dispensing system for automated dispensing of one or more liquid reagents from one or more corresponding reagent reservoirs into a recreational body of water, said system comprising:

a pump device;

a valve manifold device having a stator face and including one or more intake passages in fluid communication with the one or more corresponding reagent reservoirs, each intake passage having one end of which terminates at one or more corresponding intake ports at the stator face, said manifold device further including a dispensing passage in fluid communication with the recreational body of water, one end of said dispensing passage terminating at a dispensing port at the stator face, and a central passage in fluid communication with the pump device, one end of said central passage terminating at a drive port at the stator face; and a valve assembly including a rotor element defining a rotor face oriented in opposed relationship to and contacting said stator face in a fluid-tight manner at a rotor/stator interface, said rotor element being rotatably movable about a rotational axis, relative to said stator face, for rotational movement of said rotor face to at least a discrete first aspirate position and a dispense position, wherein, said rotor face and said stator face cooperatively defining a channel such that:

in the first aspirate position, said channel fluidly couples a selected one of the one or more intake ports and the drive port, such that said pump device can selectively aspirate liquid reagent into the central passage, and in the dispense position, said channel fluidly couples the dispensing port and the drive port, such that said pump device can selectively dispense the aspirated liquid reagent through the dispensing port and into recreation body of water.

42. The liquid dispensing system as defined by claim 41, further including:

a control system operably coupled between the switching valve and the pump device for automated control thereof.

43. The liquid dispensing system as defined by claim 41, further including:

a fluid containment reservoir, having a discrete volume, in fluid communication with the drive port and the pump device for the containment of liquid reagent therein.

44. The liquid dispensing system as defined by claim 43, wherein in the first aspirate position, a discrete volume of liquid reagent from the one reagent reservoir can be aspirated, via the pump device, through the-selected one intake port, the drive port and into the containment reservoir; and in the dispense position, the discrete volume of liquid reagent contained in the containment reservoir can be dispensed therefrom, via the pump device, through the drive port and out of the dispensing port.

45. The liquid dispensing system as defined by claim 44, wherein said manifold device further defining a wash passage having one portion configured to fluidly couple to a wash reservoir containing a wash fluid, and another portion fluidly coupled to a wash port that terminates at the stator face; and said rotor element further being rotatably movable to at least a discrete wash position, wherein the channel fluidly couples said wash port and the drive port, to enable said pump device to aspirate wash fluid through the wash port, the drive port and into the containment reservoir.

46. The liquid dispensing system as defined by claim 43, wherein, said pump device includes a pump barrel defining a cavity, and containing a reciprocating piston therein, said cavity and said reciprocating piston cooperating to define a substantial portion of the fluid containment reservoir.

47. The liquid dispensing system as defined by claim 46, wherein said pump barrel is angled during operation thereof in a manner creating an apex portion in said cavity, said pump barrel containing an offset pump port extending into said apex portion to facilitate purging thereof.

48. A liquid dispensing system for automated dispensing of one or more liquid reagents from one or more corresponding reagent reservoirs into a recreational body of water, said system comprising:

a valve manifold device having one or more intake ports, each of the one or more reagent reservoir fluidly coupled to a respective intake port, said manifold device further including a dispensing port in fluid communication with the recreational body of water;

a valve assembly movable between a plurality of discrete positions between one or more intake ports and the dispensing port for selective dispensing of the liquid reagents through the dispensing port and to the recreational body of water;

a docking assembly having a dock manifold device configured to distribute liquids therethrough, said docking assembly including mounting structure and one or more of dock connectors in fluid communication with the manifold device; and a cartridge apparatus configured to contain the one or more liquid reagent reservoirs therein, each respective reagent reservoir including a collared connector enabling access to the respective reagent contained therein, said cartridge apparatus including:

a body member defining a central cavity therein, and having a front wall;

one or more connector supports each coupled to said front wall for communication with the central cavity, and each connector support being formed and dimensioned for sliding engagement with a respective collared connector therebetween to enable receipt and support of the respective reagent reservoir in the central cavity, each said connector support cooperating with the respective collared connecter to provide a predetermined amount of sliding longitudinal movement therebetween; and a mounting device coupled to the cartridge apparatus, and configured to cooperate with the docking assembly mounting structure for movement of the cartridge apparatus between a first condition and a second condition, removably mounting the cartridge apparatus to the docking assembly, wherein during movement of the cartridge apparatus from said first condition to said second condition, the respective collared connectors of the reagent reservoirs, slideably mounted to the respective connector support, are aligned and engaged with the respective dock connector of the docking assembly for fluid-tight mating therebetween.

49. The liquid dispensing system as defined by claim 48, wherein said mounting device and said mounting structure cooperate for hinged movement of the cartridge apparatus relative the manifold device, between the first condition and the second condition, such that an engagement between the respective collared connectors of the associated reagent reservoir and the respective dock connectors is a curvilinear motion.

50. The liquid dispensing system as defined by claim 48, further including:

a pump device in fluid communication with the manifold device to pump the liquid reagents out of said dispensing port.

51. The liquid dispensing system as defined by claim 50, further including:

a control system operably coupled between the switching valve and the pump device for automated control thereof.

52. The liquid dispensing system as defined by claim 50, wherein said valve manifold device includes a stator element having a stator face and including one or more intake passages in fluid communication with the one or more corresponding reagent reservoirs, each intake passage having one end of which terminates at one or more corresponding intake ports at the stator face, said manifold device further including a dispensing passage in fluid communication with the recreational body of water, one end of said dispensing passage terminating at a dispensing port at the stator face, and a central passage in fluid communication with the pump device, one end of said central passage terminating at a drive port at the stator face; and said valve assembly including a rotor element defining a rotor face oriented in opposed relationship to and contacting said stator face in a fluid-tight manner at a rotor/stator interface, said rotor element being rotatably movable about a rotational axis, relative to said stator face, for rotational movement of said rotor face to at least a discrete first aspirate position and a dispense position, wherein, said rotor face and said stator face cooperatively defining a channel such that:

in the first aspirate position, said channel fluidly couples said selected one intake port and the drive port; and in the dispense position, said channel fluidly couples the dispensing port and the drive port.

53. The liquid dispensing system as defined by claim 52, further including:

a fluid containment reservoir, having a discrete volume, in fluid communication with the drive port and the pump device for the containment of liquid reagent therein.

54. The liquid dispensing system as defined by claim 53, wherein in the first aspirate position, a discrete volume of liquid reagent from the one reagent reservoir can be aspirated, via the pump device, through the selected one intake port, the drive port and into the containment reservoir; and in the dispense position, the discrete volume of liquid reagent contained in the containment reservoir can be dispensed therefrom, via the pump device, through the drive port and out of the dispensing port.

55. The liquid dispensing system as defined by claim 54, wherein said stator element further defining a wash passage having one portion configured to fluidly couple to a wash reservoir containing a wash fluid, and another portion fluidly coupled to a wash port that terminates at the stator face; and said rotor element further being rotatably movable to at least a discrete wash position, wherein the channel fluidly couples said wash port and the drive port, to enable said pump device to aspirate wash fluid through the wash port, the drive port and into the containment reservoir.

56. The liquid dispensing system as defined by claim 53, wherein, said pump device includes a pump barrel defining a cavity, and containing a reciprocating piston therein, said cavity and said reciprocating piston cooperating to define a substantial portion of the fluid containment reservoir.

57. The liquid dispensing system as defined by claim 56, wherein said pump device further includes a linear stepper motor coupled to said reciprocating piston for accurate volumetric actuation thereof.

58. The liquid dispensing system as defined by claim 56, wherein said pump barrel is angled during operation thereof in a manner creating an apex portion in said cavity, said pump barrel containing an offset pump port extending into said apex portion to facilitate purging thereof.

59. The liquid dispensing system as defined by claim 52, wherein said central passage is disposed at the rotational axis.

* * * * *